US012680151B2

(12) United States Patent
Matsuo et al.

(10) Patent No.: US 12,680,151 B2
(45) Date of Patent: Jul. 14, 2026

(54) STEEL MATERIAL

(71) Applicant: NIPPON STEEL CORPORATION, Tokyo (JP)

(72) Inventors: Daisuke Matsuo, Tokyo (JP); Yusaku Tomio, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 429 days.

(21) Appl. No.: 18/255,393

(22) PCT Filed: Jan. 28, 2021

(86) PCT No.: PCT/JP2021/002997
§ 371 (c)(1),
(2) Date: Jun. 1, 2023

(87) PCT Pub. No.: WO2022/162824
PCT Pub. Date: Aug. 4, 2022

(65) Prior Publication Data

US 2024/0018636 A1 Jan. 18, 2024

(51) Int. Cl.

| | |
|---|---|
| ***C22C 38/54*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |

(52) U.S. Cl.
CPC ..... *C22C 38/54* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01)

(58) Field of Classification Search
None
See application file for complete search history.

(56) References Cited

U.S. PATENT DOCUMENTS

| | | | | |
|---|---|---|---|---|
| 5,820,699 | A | 10/1998 | Asahi et al. | |
| 2020/0270715 | A1* | 8/2020 | Endo | C21D 8/105 |
| 2022/0033943 | A1* | 2/2022 | Kanki | C21D 6/005 |
| 2023/0175107 | A1* | 6/2023 | Matsuo | C22C 38/46 420/38 |

FOREIGN PATENT DOCUMENTS

| | | | | |
|---|---|---|---|---|
| EP | 4130317 | A1 | 2/2023 | |
| JP | 08246107 | A | 9/1996 | |
| JP | 10503809 | A | 4/1998 | |
| JP | 2000192196 | A | 7/2000 | |
| JP | 2012136742 | A | 7/2012 | |
| WO | WO-2020071348 | A1 * | 4/2020 | C22C 38/52 |

* cited by examiner

*Primary Examiner* — Xiaowei Su
(74) *Attorney, Agent, or Firm* — Greer, Burns & Crain, Ltd.

(57) ABSTRACT

The steel material of the present disclosure includes a chemical composition consisting of, in mass %, C: 0.035% or less, Si: 1.00% or less, Mn: 1.00% or less, P: 0.030% or less, S: 0.0050% or less, sol. Al: 0.005 to 0.100%, N: 0.001 to 0.020%, Ni: 5.00 to 7.50%, Cr: 10.00 to 14.00%, Cu: 0.01 to less than 1.50%, Mo: 1.50 to 3.50%, V: 0.01 to 1.00%, Ti: 0.02 to 0.30%, Co: 0.01 to 0.50%, Ca: 0.0003 to 0.0030%, O: 0.0050% or less, W: 0 to 1.50%, Nb: 0 to 0.50%, B: 0 to 0.0050%, Mg: 0 to 0.0050%, and rare earth metals (REM): 0 to 0.020%, with the balance being Fe and impurities, in which a total number density of Mn sulfide having an equivalent circular diameter of 1.0 μm or more and Ca sulfide having an equivalent circular diameter of 2.0 μm or more is 0.50/mm$^2$ or less.

16 Claims, No Drawings

STEEL MATERIAL

TECHNICAL FIELD

The present invention relates to a steel material, and more particularly to a steel material suitable for use in a sour environment containing hydrogen sulfide and carbon dioxide gas.

BACKGROUND ART

Oil wells and gas wells (hereinafter, oil wells and gas wells are generally referred to as "oil wells") include an environment which contains large amounts of corrosive substances. Examples of corrosive substance include corrosive gases such as hydrogen sulfide ($H_2S$) gas and carbon dioxide ($CO_2$) gas. In the present description, an environment containing hydrogen sulfide and carbon dioxide gas is called as a "sour environment". The temperature of a sour environment is, though it depends on the depth of a well, in a range from a normal temperature to about 200° C. The term "normal temperature" as used herein means 24±3° C. in this description.

It is known that chromium (Cr) is effective for improving the carbon-dioxide gas corrosion resistance of steel. Therefore, in an oil well in an environment containing a large amount of carbon dioxide gas, martensitic stainless steel materials containing about 13 mass % of Cr, typified by API L80 13Cr Steel material (normal 13Cr steel material) and Super 13Cr Steel material in which C content is reduced, are used.

Japanese Unexamined Patent Application Publication (Translation of PCT Application) No. 10-503809 (Patent Literature 1), Japanese Patent Application Publication No. 2000-192196 (Patent Literature 2), Japanese Patent Application Publication No. 08-246107 (Patent Literature 3), and Japanese Patent Application Publication No. 2012-136742 (Patent Literature 4) each propose a steel material excellent in SSC resistance.

The steel material according to Patent Literature 1 consists of, in weight %, C: 0.005 to 0.05%, Si≤0.50%, Mn: 0.1 to 1.0%, P≤0.03%, S≤0.005%, Mo: 1.0 to 3.0%, Cu: 1.0 to 4.0%, Ni: 5 to 8%, and Al≤0.06%, with the balance being Fe and impurities, and further satisfies Cr+1.6Mo≥13 and 40C+34N+Ni+0.3Cu−1.1Cr−1.8Mo≥−10.5. The microstructure of the martensitic stainless steel of this literature is a tempered martensite structure. Patent Literature 1 states that containing 1.0 to 3.0% of Mo can improve the SSC resistance.

The steel material according to Patent Literature 2 consists of, in weight %, C: 0.001 to 0.05%, Si: 0.05 to 1%, Mn: 0.05 to 2%, P: 0.025% or less, S: 0.01% or less, Cr: 9 to 14%, Mo: 3.1 to 7%, Ni: 1 to 8%, Co: 0.5 to 7%, sol. Al: 0.001 to 0.1%, N: 0.05% or less, O (oxygen): 0.01% or less, Cu: 0 to 5%, and W: 0 to 5%, with the balance being Fe and unavoidable impurities. When Mo is contained, the Ms point decreases. Accordingly, by containing Co along with Mo, decrease in the Ms point is suppressed so that the microstructure is formed of a martensite single phase structure. Patent Literature 2 states that as a result of that, it is possible to improve the SSC resistance while maintaining a strength of 80 ksi or more (552 MPa or more).

The chemical composition of the martensitic stainless steel according to Patent Literature 3 consists of, in weight %, C: 0.005% to 0.05%, Si: 0.05% to 0.5%, Mn: 0.1% to 1.0%, P: 0.025% or less, S: 0.015% or less, Cr: 12 to 15%, Ni: 4.5% to 9.0%, Cu: 1% to 3%, Mo: 2% to 3%, W: 0.1% to 3%, Al: 0.005 to 0.2%, and N: 0.005% to 0.1%, with the balance being Fe and unavoidable impurities. The above described chemical composition further satisfies 40C+34N+Ni+0.3Cu+Co−1.1Cr—1.8Mo−0.9W≥−10. The Patent Literature 3 states that excellent SSC resistance can be obtained by arranging a steel material containing 12 to 15% of Cr to contain C: less than 0.05%, Ni: 4.5% or more, Cu: 1 to 3%, Mo: 2 to 3%, and W: 1.0 to 3%.

The martensitic stainless seamless steel pipe according to Patent Literature 4 consists of, in mass %. C: 0.01% or less, Si: 0.5% or less, Mn: 0.1 to 2.0%, P: 0.03% or less, S: 0.005% or less, Cr: 14.0 to 15.5%, Ni: 5.5 to 7.0%, Mo: 2.0 to 3.5%, Cu: 0.3 to 3.5%, V: 0.20% or less, Al: 0.05% or less, and N: 0.06% or less, with the balance being Fe and unavoidable impurities. The martensitic stainless seamless steel pipe according to this literature has a yield strength of 655 to 862 MPa, and a yield ratio of 0.90 or more. The Patent Literature 4 states that it is possible to achieve excellent SSC resistance while maintaining a strength of 655 MPa or more by arranging that the C content is 0.01% or less, the contents of Cr, Ni, and Mo are in proper ranges, and further proper amounts of Cu and V, or a proper amount of W is contained.

CITATION LIST

Patent Literature

Patent Literature 1: Japanese Translation of PCT International Application Publication No. 10-503809

Patent Literature 2: Japanese Patent Application Publication No. 2000-192196

Patent Literature 3: Japanese Patent Application Publication No. 08-246107

Patent Literature 4: Japanese Patent Application Publication No. 2012-136742

SUMMARY OF INVENTION

Technical Problem

Every one of the above described Patent Literatures 1 to 4 proposes means for improving SSC resistance in a sour environment by adjusting the content of each element in the chemical composition. However, SSC resistance of steel material in a sour environment may be improved by any means other than those proposed in the above described patent literatures.

It is an object of the present disclosure to provide a steel material having excellent SSC resistance.

Solution to Problem

A steel material according to the present disclosure includes a chemical composition consisting of: in mass %, C: 0.035% or less;
Si: 1.00% or less;
Mn: 1.00% or less;
P: 0.030% or less;
S: 0.0050% or less;
sol. Al: 0.005 to 0.100%;
N: 0.001 to 0.020%;
Ni: 5.00 to 7.50%;
Cr: 10.00 to 14.00%;
Cu: 0.01 to less than 1.50%;
Mo: 1.50 to 3.50%;
V: 0.01 to 1.00%;
Ti: 0.02 to 0.30%;

Co: 0.01 to 0.50%;
Ca: 0.0003 to 0.0030%;
O: 0.0050% or less;
W: 0 to 1.50%;
Nb: 0 to 0.50%;
B: 0 to 0.0050%;
Mg: 0 to 0.0050%; and
rare earth metals (REM): 0 to 0.020%,
with the balance being Fe and impurities, wherein
among inclusions in the steel material, a total number density of Mn sulfide having a Mn content of 10% or more and a S content of 10% or more, and having an equivalent circular diameter of 1.0 μm or more, and Ca sulfide having a Ca content of 20% or more, a S content of 10% or more, and a Mn content of less than 10%, and having an equivalent circular diameter of 2.0 μm or more is 0.50/mm$^2$ or less.

Advantageous Effects of Invention

A steel material according to the present disclosure has excellent SSC resistance.

DESCRIPTION OF EMBODIMENTS

The present inventors have studied on a steel material which has excellent SSC resistance in a sour environment.

First, the present inventors studied on the chemical composition of a steel material which can exhibit excellent SSC resistance in a sour environment. As a result, they came to consider that a steel material having a chemical composition consisting of, in mass %, C: 0.035% or less, Si: 1.00% or less, Mn: 1.00% or less, P: 0.030% or less, S: 0.0050% or less, sol. Al: 0.005 to 0.100%, N: 0.001 to 0.020%, Ni: 5.00 to 7.50%, Cr: 10.00 to 14.00%, Cu: 0.01 to less than 1.50%, Mo: 1.50 to 3.50%, V: 0.01 to 1.00%, Ti: 0.02 to 0.30%, Co: 0.01 to 0.50%, O: 0.0050% or less, W: 0 to 1.50%, Nb: 0 to 0.50%, B: 0 to 0.0050%, Mg: 0 to 0.0050%, and rare earth metals (REM): 0 to 0.020%, with the balance being Fe and impurities can achieve excellent SSC resistance in a sour environment.

However, even in a steel material in which the content of each element of the chemical composition is within the above described range, there are cases in which sufficient SSC resistance cannot be achieved, for example, when the steel material has a high yield strength such as 110 ksi or more (758 MPa or more). Then, the present inventors investigated the cause of deterioration of SSC resistance in a steel material having the above described chemical composition. Consequently, the present inventors have obtained the following findings.

It is known that in a low alloy steel material having a Cr content of 2.00% or less, SSC is likely to occur in a sour environment as a result of inclusion (oxide, sulfide, nitride, etc.) in the steel material serving as a starting point of crack. In contrast, in a high alloy steel material having a Cr content of 10.00% or more, a strong passivation film is formed on the surface of steel material due to high Cr content, compared with a low alloy steel material. For that reason, conventionally it is considered that SSC starting from an inclusion is not likely to occur in the high alloy steel material.

However, the study and investigation by the present inventors revealed that even in a high alloy steel material, when its yield strength is a high strength of 110 ksi or more (758 MPa or more), SSC may occur in a sour environment by the following mechanism. When Mn sulfide is present in the surface layer of a steel material in a sour environment, the Mn sulfide in the surface layer will dissolve due to H2S gas in the sour environment. A depression will be formed on the surface of steel material as a trace of dissolution of Mn sulfide. A depression which is formed by dissolution of large-sized Mn sulfide is likely to serve as a starting point of SSC occurrence.

In a low alloy steel material, all of coarse inclusions (oxide, sulfide, nitride, etc.) in the steel material serve as a starting point of SSC. On the other hand, in the case of a high alloy steel material, Mn sulfide which is a particular inclusion among the inclusions present in the surface layer of the steel material dissolves, thus forming a depression on the surface of steel material, which will result in occurrence of SSC. As so far described, the present inventors have made it clear that in the case of a high alloy steel material having a Cr content of 10.00% or more, SSC may occur by a mechanism different from that in the case of a low alloy steel material.

Based on the above described findings, the present inventors came to consider that in the case of a steel material having the above described chemical composition, it is possible to suppress depressions on the surface, which are attributable to dissolution of Mn sulfide, by suppressing the formation of large-sized Mn sulfide, thereby improving the SSC resistance of steel material. Accordingly, the present inventors came to think that further containing 0.0003 to 0.0030 mass % of Ca in addition to the above described chemical composition can suppress formation of large-sized Mn sulfide. That is, the present inventors came to consider that a steel material having a chemical composition consisting of, in mass %, C: 0.035% or less, Si: 1.00% or less, Mn: 1.00% or less, P: 0.030% or less, S: 0.0050% or less, sol. Al: 0.005 to 0.100%, N: 0.001 to 0.020%, Ni: 5.00 to 7.50%, Cr: 10.00 to 14.00%, Cu: 0.01 to less than 1.50%, Mo: 1.50 to 3.50%, V: 0.01 to 1.00%, Ti: 0.02 to 0.30%, Co: 0.01 to 0.50%, Ca: 0.0003 to 0.0030%, O: 0.0050% or less, W: 0 to 1.50%, Nb: 0 to 0.50%, B: 0 to 0.0050%, Mg: 0 to 0.0050%, and rare earth metals (REM): 0 to 0.020%, with the balance being Fe and impurities can suppress formation of large-sized Mn sulfide. Specifically, as a result of containing Ca, Ca combines with S to form Ca sulfide. As a result of formation of Ca sulfide, the amount of S to be combined with Mn decreases. For that reason, formation of large-sized Mn sulfide will be suppressed.

Accordingly, a steel material having the above described chemical composition in which Ca is contained was produced to investigate the SSC resistance thereof in a sour environment. The result has revealed that although it is possible to suppress formation of large-sized Mn sulfide, there may still be a case where excellent SSC resistance cannot be achieved. Accordingly, the present inventors conducted further investigation and study on the cause of low SSC resistance. As a result, the present inventors have made it clear that when the above described content of Ca is contained, there may be a case in which the excellent SSC resistance cannot be achieved by the following mechanism.

When the above described content of Ca is contained in the chemical composition of a steel material, Ca sulfide is formed and formation of large-sized Mn sulfide is suppressed. However, Ca sulfide itself, like Mn sulfide, is also likely to dissolve in a sour environment. For that reason, when a large-sized Ca sulfide is present in the surface layer of the steel material, it dissolves thereby forming a depression on the surface of a steel material as in the case of Mn sulfide. Due to such depression on the surface, which is attributable to Ca sulfide, there is a case in which SSC occurs.

Based on the findings described above, the present inventors came to think that if it is possible not only to suppress formation of large-sized Mn sulfides but also to suppress formation of large-sized Ca sulfides in a steel material having the above described chemical composition, excellent SSC resistance can be achieved in a sour environment even when the steel material has a yield strength of 110 ksi or more (758 MPa or more). Then, the present inventors conducted further study on to what level a total number per unit area of large-sized Mn sulfide and large-sized Ca sulfide needs to be suppressed to achieve excellent SSC resistance even if the steel material has a yield strength of 110 ksi or more (758 MPa or more). As a result, the present inventors have found that when a total number density of Mn sulfide having an equivalent circular diameter of 1.0 μm or more and Ca sulfide having an equivalent circular diameter of 2.0 μm or more is $0.50/mm^2$ or less, it is possible to achieve excellent SSC resistance even in a sour environment even if the steel material has a yield strength of 110 ksi or more (758 MPa or more).

As described so far, the steel material of the present embodiment has been completed in a viewpoint of suppressing depressions formed on the surface of a steel material by Mn sulfide and Ca sulfide, which are those of inclusions that dissolve in a sour environment, in a steel material having a Cr content of 10.00% or more. The steel material of the present embodiment has the following configuration.

[1]

A steel material, including a chemical composition consisting of: in mass %,

C: 0.035% or less;

Si: 1.00% or less;

Mn: 1.00% or less;

P: 0.030% or less;

S: 0.0050% or less;

sol. Al: 0.005 to 0.100%:

N: 0.001 to 0.020%;

Ni: 5.00 to 7.50%:

Cr: 10.00 to 14.00%;

Cu: 0.01 to less than 1.50%;

Mo: 1.50 to 3.50%;

V: 0.01 to 1.00%:

Ti: 0.02 to 0.30%;

Co: 0.01 to 0.50%;

Ca: 0.0003 to 0.0030%;

O: 0.0050% or less;

W: 0 to 1.50%;

Nb: 0 to 0.50%;

B: 0 to 0.0050%;

Mg: 0 to 0.0050%; and rare earth metals (REM): 0 to 0.020%, with the balance being Fe and impurities, wherein among inclusions in the steel material, a total number density of Mn sulfide having a Mn content of 10% or more and a S content of 10% or more, and having an equivalent circular diameter of 1.0 μm or more, and Ca sulfide having a Ca content of 20% or more, a S content of 10% or more, and a Mn content of less than 10%, and having an equivalent circular diameter of 2.0 μm or more is $0.50/mm^2$ or less.

[2]

The steel material according to [1], wherein the chemical composition contains

W: 0.01 to 1.50%.

[3]

The steel material according to [1] or [2], wherein the chemical composition contains Nb: 0.01 to 0.50%.

[4]

The steel material according to any one of [1] to [3], wherein the chemical composition contains one or more types of element selected from the group consisting of:

B: 0.0001 to 0.0050%,

Mg: 0.0001 to 0.0050%, and rare earth metals (REM): 0.001 to 0.020%.

[5]

The steel material according to any one of [1] to [4], wherein the steel material is a seamless steel pipe for oil country tubular goods.

Hereinafter, the steel material of the present embodiment will be described in detail. The term "%" relating to an element means, unless otherwise stated, mass %.

[Chemical Composition]

The chemical composition of the steel material of the present embodiment contains the following elements.

C: 0.035% or Less

Carbon (C) is unavoidably contained. That is, the C content is more than 0%. C improves hardenability of steel material, thus increasing strength of steel material. However, when the C content is more than 0.035%, strength of steel material will become too high, thus deteriorating SSC resistance even if the contents of other elements are within the range of the present embodiment. Therefore, the C content is 0.035% or less. The C content is preferably as low as possible. However, excessively reducing the C content will result in increase in production cost. Therefore, considering industrial production, a lower limit of the C content is preferably 0.001%, more preferably 0.003%, further preferably 0.007%, further preferably 0.008%, and further preferably 0.009%. An upper limit of the C content is preferably 0.030%, more preferably 0.025%, further preferably 0.020%, further preferably 0.018%, further preferably 0.016%, and further preferably 0.015%.

Si: 1.00% or Less

Silicon (Si) is unavoidably contained. That is, the Si content is more than 0%. Si deoxidizes steel. However, when the Si content is more than 1.00%, the deoxidization effect will be saturated, and hot workability of steel material deteriorates even if the contents of other elements are within the range of the present embodiment. Therefore, the Si content is 1.00% or less. A lower limit of the Si content is preferably 0.01%, more preferably 0.05%, further preferably 0.10%, further preferably 0.15%, further preferably 0.20%, and further preferably 0.25%. An upper limit of the Si content is preferably 0.70%, more preferably 0.60%, further preferably 0.50%, and further preferably 0.45%.

Mn: 1.00% or Less

Manganese (Mn) is unavoidably contained. That is, the Mn content is more than 0%. Mn improves hardenability of steel material, thus increasing strength of steel material. However, when the Mn content is too high, Mn forms a large number of coarse Mn sulfides. In a sour environment, coarse MnS which presents in the vicinity of the surface layer of steel material may dissolve. At this moment, a depression which is a trace of dissolved MnS is formed. This depression may serve as a starting point of SSC, thus causing SSC. When the Mn content is more than 1.00%, depressions which are traces of dissolved MnS are formed, thus deteriorating the SSC resistance even if the contents of other elements are within the range of the present embodiment. Therefore, the Mn content is 1.00% or less. A lower limit of the Mn content is preferably 0.01%, more preferably 0.05%, further preferably 0.10%, and further preferably 0.15%. An upper limit of the Mn content is preferably 0.80%, more preferably 0.70%, further preferably 0.60%, and further preferably 0.50%.

P: 0.030% or Less

Phosphorous (P) is an impurity which is unavoidably contained. That is, the P content is more than 0%. P segregates at grain boundaries, thereby facilitating the occurrence of SSC. When the P content is more than 0.030%, the SSC resistance of steel material significantly deteriorates even if the contents of other elements are within the range of the present embodiment. Therefore, the P content is 0.030% or less. An upper limit of the P content is preferably 0.025%, more preferably 0.020%, and further preferably 0.018%. The P content is preferably as low as possible. However, excessively reducing the P content will result in increase in production cost. Therefore, considering industrial production, a lower limit of the P content is preferably 0.001%, more preferably 0.002%, and further preferably 0.003%.

S: 0.0050% or Less

Sulfur (S) is an impurity which is unavoidably contained. That is, the S content is more than 0%. Like P S segregates at grain boundaries, thereby facilitating the occurrence of SSC. When the S content is more than 0.0050%, the SSC resistance of steel material significantly deteriorates even if the contents of other elements are within the range of the present embodiment. Therefore, the S content is 0.0050% or less. An upper limit of the S content is preferably 0.0040%, more preferably 0.0030%, further preferably 0.0025%, further preferably 0.0020%, and further preferably 0.0015%. The S content is preferably as low as possible. However, excessively reducing the S content will result in increase in production cost. Therefore, considering industrial production, a lower limit of the S content is preferably 0.0001%, more preferably 0.0002%, and further preferably 0.0003%.

Sol. Al: 0.005 to 0.100%

Aluminum (Al) deoxidizes steel. When the sol. Al content is less than 0.005%, the aforementioned effect cannot be sufficiently obtained even if the contents of other elements are within the range of the present embodiment. On the other hand, when the sol. Al content is more than 0.100%, coarse oxides are formed, thus decreasing toughness of steel material even if the contents of other elements are within the range of the present embodiment. Therefore, the sol. Al content is 0.005 to 0.100%. A lower limit of the sol. Al content is preferably 0.010%, more preferably 0.013%, further preferably 0.015%, and further preferably 0.018%. An upper limit of the sol. Al content is preferably 0.080%, more preferably 0.060%, further preferably 0.055%, and further preferably 0.050%. The sol. Al content as used in this description means the content of acid soluble Al.

N: 0.001 to 0.020%

Nitrogen (N) combines with Ti to form fine Ti nitride. The fine TiN suppresses the coarsening of crystal grain by the pinning effect. As a result, strength of steel material is increased. When the N content is less than 0.001%, the aforementioned effect cannot be sufficiently obtained even if the contents of other elements are within the range of the present embodiment. On the other hand, when the N content is more than 0.020%, coarse nitrides will be formed, thereby deteriorating toughness of steel material even if the contents of other elements are within the range of the present embodiment. Therefore, the N content is 0.001 to 0.020%. A lower limit of the N content is preferably 0.002%, more preferably 0.003%, further preferably 0.004%, and further preferably 0.005%. An upper limit of the N content is preferably 0.018%, more preferably 0.016%, further preferably 0.014%, and further preferably 0.012%.

Ni: 5.00 to 7.50%

Nickel (Ni) is an austenite forming element and causes the structure after quenching to become martensitic. This results in increase in strength of steel material. Further, Ni forms sulfide on a passivation film in a sour environment. Ni sulfide suppresses chloride ions ($Cl^-$) and hydrogen sulfide ions ($HS^-$) from coming into contact with the passivation film, thus suppressing the passivation film from being destroyed by chloride ions and hydrogen sulfide ions. For this reason, the SSC resistance of steel material is improved. When the Ni content is less than 5.00% the aforementioned effects cannot be sufficiently obtained even if the contents of other elements are within the range of the present embodiment. On the other hand, when the Ni content is more than 7.50%, a hydrogen diffusion coefficient in steel material decreases even if the contents of other elements are within the range of the present embodiment. If the hydrogen diffusion coefficient in steel material decreases, the SSC resistance of steel material will deteriorate. Therefore, the Ni content is 5.00 to 7.50%. A lower limit of the Ni content is preferably 5.10%, more preferably 5.20%, and further preferably 5.30%. An upper limit of the Ni content is preferably 7.40%, more preferably 7.30%, and further preferably 7.20%.

Cr: 10.00 to 14.00%

Chromium (Cr) formed a passivation film on the surface of steel material, thus improving the SCC resistance of steel material. When the Cr content is less than 10.00%, the aforementioned effect cannot be sufficiently obtained even if the contents of other elements are within the range of the present embodiment. On the other hand, when the Cr content is more than 14.00%, δ (delta) ferrite becomes more likely to be formed in steel material, thus deteriorating toughness of steel material even if the contents of other elements are within the range of the present embodiment. Therefore, the Cr content is 10.00 to 14.00%. A lower limit of the Cr content is preferably 10.50%, more preferably 11.00%, further preferably 11.50%, further preferably 12.00%, and further preferably 12.20%. An upper limit of the Cr content is preferably 13.80%, more preferably 13.60%, further preferably 13.50%, further preferably 13.45%, and further preferably 13.40%.

Cu: 0.01 to less than 1.50%

Cupper (Cu) is, like Ni, an austenite forming element and causes the structure after quenching to become martensitic. When the Cu content is less than 0.01%, the aforementioned effects will not be sufficiently obtained. On the other hand, when the Cu content is 1.50% or more, the aforementioned effects will be saturated and the production cost will increase. Therefore, the Cu content is 0.01 to less than 1.50%. A lower limit of the Cu content is preferably 0.05%, more preferably 0.10%, and further preferably 0.15%. An upper limit of the Cu content is preferably 1.40%, more preferably 1.25%, and further preferably 1.00%.

Mo: 1.50 to 3.50%

Molybdenum (Mo) forms sulfide on a passivation film in a sour environment. Mo sulfide suppresses chloride ions ($Cl^-$) and hydrogen sulfide ions ($HS^-$) from coming into contact with the passivation film, thus suppressing the passivation film from being destroyed by chloride ions and hydrogen sulfide ions. For this reason, the SSC resistance of steel material will be improved. Further, Mo dissolves in steel material, thereby increasing strength of steel material. When the Mo content is less than 1.50%, the aforementioned effects cannot be sufficiently obtained even if the contents of other elements are within the range of the present embodiment. On the other hand, when the Mo content is more than 3.50%, austenite will hardly be stabilized, even if the contents of other elements are within the range of the present embodiment. As a result, a microstructure mainly composed of martensite will not be obtained in a stable manner. Therefore, the Mo content is 1.50 to 3.50%. A lower limit of the Mo content is preferably 1.60%, more preferably 1.70%, and further preferably 1.80%. An upper limit of the Mo content is preferably 3.40%, more preferably 3.30%, and further preferably 3.20%.

V: 0.01 to 1.00%

Vanadium (V) improves hardenability of steel material, thereby increasing strength of steel material. When the V content is less than 0.01%, the aforementioned effect cannot be obtained even if the contents of other elements are within the range of the present embodiment. On the other hand, when the V content is more than 1.00%, hardenability of steel material will be increased excessively, thus deteriorating the SSC resistance of steel material even if the contents of other elements are within the range of the present embodiment. Therefore, the V content is 0.01 to 1.00%. A lower limit of the V content is preferably 0.02%, and more preferably 0.03%. An upper limit of the V content is preferably 0.70%, more preferably 0.50%, further preferably 0.30%, further preferably 0.20%, further preferably 0.15%, and further preferably 0.10%.

Ti: 0.02 to 0.30%

Titanium (Ti) combines with C and/or N to form carbides and/or nitrides. In this case, the coarsening of crystal grain is suppressed by the pinning effect, and thereby strength of steel material is increased. When the Ti content is less than 0.02%, the aforementioned effect cannot be sufficiently obtained even if the contents of other elements are within the range of the present embodiment. On the other hand, when the Ti content is more than 0.30%, δ ferrite becomes likely to be formed, thereby deteriorating toughness of steel material even if the contents of other elements are within the range of the present embodiment. Therefore, the Ti content is 0.02 to 0.30%. A lower limit of the Ti content is preferably 0.05%, and more preferably 0.07%. An upper limit of the Ti content is preferably 0.25%, more preferably 0.20%, further preferably 0.18%, and further preferably 0.16%.

Co: 0.01 to 0.50%

Cobalt (Co) forms sulfide on a passivation film in a sour environment. Co sulfide suppresses chloride ions ($Cl^-$) and hydrogen sulfide ions ($HS^-$) from coming into contact with the passivation film, thus suppressing the passivation film from being destroyed by chloride ions and hydrogen sulfide ions. For this reason, the SSC resistance of steel material will be improved. Further, Co improves hardenability of steel material, and ensures a stable high strength of steel material, especially during industrial production. Specifically, Co suppresses formation of retained austenite, thus suppressing the variation of strength of steel material. When the Co content is less than 0.01%, the aforementioned effects cannot be sufficiently obtained even if the contents of other elements are within the range of the present embodiment. On the other hand, when the Co content is more than 0.50%, toughness of steel material will deteriorate even if the contents of other elements are within the range of the present embodiment. Therefore, the Co content is 0.01 to 0.50%. A lower limit of the Co content is preferably 0.02%, more preferably 0.04%, further preferably 0.08%, and further preferably 0.10%. An upper limit of the Co content is preferably 0.48%, more preferably 0.45%, further preferably 0.40%, and further preferably 0.35%.

Ca: 0.0003 to 0.0030%

Calcium (Ca) combines with S in steel material to form Ca sulfide, thereby suppressing the formation of Mn sulfide. When Mn sulfide having an equivalent circular diameter of 1.0 μm or more is present in the surface layer of steel material, the Mn sulfide in the surface layer may dissolve in a sour environment. In this case, a depression is formed in the trace of dissolved Mn sulfide. The depression which is formed on the surface of steel material is likely to serve as a starting point for occurrence of SSC. Ca suppresses the formation of Mn sulfide, thus decreasing a number density of Mn sulfide having an equivalent circular diameter of 1.0 μm or more. As a result, the SSC resistance of steel material will be improved. When the Ca content is less than 0.0003%, the aforementioned effect cannot be sufficiently obtained even if the contents of other elements are within the range of the present embodiment. On the other hand, when the Ca content is more than 0.0030%, Ca sulfide having an equivalent circular diameter of 2.0 μm or more will be excessively formed even if the contents of other elements are within the range of the present embodiment. When Ca sulfide having an equivalent circular diameter of 2.0 μm or more is present in the surface layer of steel material, as with the above described Mn sulfide, it may dissolve in a sour environment, thereby forming a depression on the surface of steel material. In this case, the SSC resistance of steel material deteriorates. Therefore, the Ca content is 0.0003 to 0.0030%. A lower limit of the Ca content is preferably 0.0005%, more preferably 0.0007%, and further preferably 0.0009%. An upper limit of the Ca content is preferably 0.0029%, more preferably 0.0028%, further preferably 0.0027%, and further preferably 0.0026%.

O: 0.0050% or less

Oxygen (O) is an impurity which is unavoidably contained. That is, the O content is more than 0%. O forms oxides, thereby deteriorating toughness of steel material. When the O content is more than 0.0050%, toughness of steel material significantly deteriorates even if the contents of other elements are within the range of the present embodiment. Therefore, the O content is 0.0050% or less. An upper limit of the O content is preferably 0.0045%, more preferably 0.0040%, further preferably 0.0035%, and further preferably 0.0030%. The O content is preferably as low as possible. However, excessively reducing the O content will result in increase in production cost. Therefore, considering industrial production, a lower limit of the O content is preferably 0.0001%, and more preferably 0.0002%.

The balance of the chemical composition of the steel material according to the present embodiment is Fe and impurities. Here, impurities refers to elements which, during industrial production of the steel material, are mixed from ores and scraps as the raw material, or from the production environment or the like, and which are not intentionally contained, but are allowed within a range not adversely affecting the steel material of the present embodiment.

[Regarding Optional Elements]

The chemical composition of the steel material according to the present embodiment may contain Win place of part of Fe.

W: 0 to 1.50%

Tungsten (W) is an optional element and may not be contained. That is, the W content may be 0%. When contained, W stabilizes passivation film in a sour environment, thereby suppressing the passivation film from being destroyed by chloride ions and hydrogen sulfide ions. Therefore, the SSC resistance of steel material is improved. If W is contained even in a small amount, the aforementioned effect will be obtained to some extent. However, when the W content is more than 1.50%, W combines with C to form coarse carbides. In this case, toughness of steel material will deteriorate even if the contents of other elements are within the range of the present embodiment. Therefore, the W content is 0 to 1.50%. A lower limit of the W content is preferably 0.01%, more preferably 0.05%, further preferably 0.10%, further preferably 0.30%, and further preferably 0.50%. An upper limit of the W content is preferably 1.45%, more preferably 1.40%, and further preferably 1.37%.

The chemical composition of the steel material according to the present embodiment may contain Nb in place of part of Fe.

Nb: 0 to 0.50%

Niobium (Nb) is an optional element and may not be contained. That is, the Nb content may be 0%. When contained, Nb combines with C and/or N to form Nb carbide and Nb carbonitride. In this case, coarsening of crystal grain is suppressed by the pinning effect, thereby increasing strength of steel material. If Nb is contained even in a small amount, the aforementioned effect will be obtained to some extent. However, when the Nb content is more than 0.50%, Nb carbide and/or Nb carbonitride will be excessively formed, thereby deteriorating toughness of steel material even if the contents of other elements are within the range of the present embodiment. Therefore, the Nb content is 0 to 0.50%. A lower limit of the Nb content is preferably 0.01%, more preferably 0.05%, further preferably 0.10% and further preferably 0.15%. An upper limit of the Nb content is preferably 0.45%, more preferably 0.40%, and further preferably 0.35%.

The chemical composition of the steel material according to the present embodiment may contain B, Mg, and rare earth metal (REM) in place of part of Fe.

B: 0 to 0.0050%

Boron (B) is an optional element and may not be contained. That is, the B content may be 0%. When contained, B dissolves in steel material, thereby improving hot workability of steel material. If B is contained even in a small amount, the aforementioned effect will be obtained to some extent. However, when the B content is more than 0.0050%, coarse B nitride is formed, thereby deteriorating toughness of steel material even if the contents of other elements are within the range of the present embodiment. Therefore, the B content is 0 to 0.0050%. A lower limit of the B content is preferably 0.0001%, more preferably 0.0002%, further preferably 0.0003%, and further preferably 0.0004%. An upper limit of the B content is preferably 0.0040%, more preferably 0.0030%, and further preferably 0.0020%.

Mg: 0 to 0.0050%

Magnesium (Mg) is an optional element and may not be contained. That is, the Mg content may be 0%. When contained, Mg controls the morphology of inclusions, thereby improving hot workability of steel material. If Mg is contained even in a small amount, the aforementioned effect will be obtained to some extent. However, when the Mg content is more than 0.0050%, coarse oxide is formed. In this case, toughness of steel material deteriorates even if the contents of other elements are within the range of the present embodiment. Therefore, the Mg content is 0 to 0.0050%. A lower limit of the Mg content is preferably 0.0001%, more preferably 0.0002%, and further preferably 0.0003%. An upper limit of the Mg content is preferably 0.0040%, more preferably 0.0035%, further preferably 0.0030%, and further preferably 0.0025%.

Rare Earth Metal (REM): 0 to 0.020%

Rare earth metal (REM) is an optional element and may not be contained. That is, the REM content may be 0%. When contained, as with Mg, REM controls the morphology of inclusions, thereby improving hot workability of steel material. When REM is contained even in a small amount, the aforementioned effect can be obtained to some extent. However, when the REM content is more than 0.020%, coarse oxides are formed. In this case, toughness of steel material deteriorates even if the contents of other elements are within the range of the present embodiment. Therefore, the REM content is 0 to 0.020%. A lower limit of the REM content is preferably 0.001%, more preferably 0.003%, and further preferably An upper limit of the REM content is preferably 0.019%, more preferably and further preferably 0.017%.

Note that the REM as used herein means elements of one or more types of elements selected from the group consisting of Scandium (Sc) whose element number is 21, Yttrium (Y) whose element number is 39, lanthanoid series which include elements from Lanthanum (La) whose element number is 57 to Lutetium (Lu) whose element number is 71. The REM content as used in this description means the total content of these elements.

As described below, the yield strength of the steel material is preferably 758 MPa or more (110 ksi or more), and more preferably 862 MPa or more (125 ksi or more). The preferable chemical composition in accordance with the yield strength to be obtained in the present embodiment is as follows.

Specifically, when a yield strength of 758 to less than 862 MPa is to be obtained, the chemical composition of the steel material is preferably such that all of the ranges of the contents of elements described above are satisfied, and the lower limit of the C content is 0.002%, 0.005%, 0.007%, 0.008%, or 0.009%. When a yield strength of 758 to less than 862 MPa is to be obtained, the chemical composition of the steel material is further preferably such that all of the ranges of the contents of elements described above are satisfied, and the lower limit of the Ni content is 5.10%, 5.20%, or 5.30%. When a yield strength of 758 to less than 862 MPa is to be obtained, the chemical composition of the steel material is further preferably such that all of the ranges of the contents of elements described above are satisfied, and the upper limit of the Ni content is 7.00%, 6.80%, 6.50%, or less than 6.50%. When a yield strength of 758 to less than 862 MPa is to be obtained, the chemical composition of the steel material is further preferably such that all of the ranges of the contents of elements described above are satisfied, and the lower limit of the Mo content is 1.60%, 1.70%, or 1.80%. When a yield strength of 758 to less than 862 MPa is to be obtained, the chemical composition of the steel material is further preferably such that all of the ranges of the contents of elements described above are satisfied, and the upper limit of the Mo content is 3.20%, 3.00%, 2.80%, 2.50%, or less than 2.50%.

Specifically, when a yield strength of 862 MPa or more is to be obtained, the chemical composition of the steel material is preferably such that all of the ranges of the contents of elements described above are satisfied, and the lower limit of the Ni content is 5.50%, 6.00%, 6.30%, 6.50%, or more than 6.50%. When a yield strength of 862 MPa or more is to be obtained, the chemical composition of the steel material is further preferably such that all of the ranges of the contents of elements described above are satisfied, and the upper limit of the Ni content is 7.40%, 7.30%, or 7.20%. When a yield strength of 862 MPa or more is to be obtained, the chemical composition of the steel material is further preferably such that all of the ranges of the contents of elements described above are satisfied, and the lower limit of the Mo content is 1.80%, 2.10%, or 2.30%. When a yield strength of 862 MPa or more is to be obtained, the chemical composition of the steel material is further preferably such that all of the ranges of the contents of elements described above are satisfied, and the upper limit of the Mo content is 3.40%, 3.30%, or 3.20%.

[Regarding Mn Sulfide and Ca Sulfide in Steel Material]

In the steel material of the present embodiment, among inclusions in the steel material, Mn sulfide and Ca sulfide are defined as follows.

Mn sulfide: Inclusion having, in mass %, a Mn content of 10% or more and a S content of 10% or more, with the mass % of the inclusion being 100%.

Ca sulfide: Inclusion having, in mass %, a Ca content of 20% or more, a S content of 10% or more, and a Mn content of less than 10%, with the mass % of the inclusion being 100%.

In the steel material of the present embodiment, among inclusions in the steel material, a total number density (/mm$^2$) of Mn sulfide and Ca sulfide, each of which has a size that allows to dissolve in a sour environment and to form a depression in the surface layer, is decreased. Mn sulfide in a steel material exists in a manner to extend in the longitudinal direction (rolling direction) of the steel material. On the other hand, Ca sulfide in a steel material exists in a spherical shape. For this reason, Mn sulfide and Ca sulfide have a different size at which a depression serving as a starting point of SSC is likely to be formed. A diameter when the area of Mn sulfide or Ca sulfide is converted into a circle is defined as an equivalent circular diameter. In a case of a steel material in which the content of each element in the chemical composition is within the range of the present embodiment, a number per unit area of Mn sulfide having an equivalent circular diameter of 1.0 μm or more and Ca sulfide having an equivalent circular diameter of 2.0 μm or more correlates with SSC resistance in a sour environment.

In the present description, a total number of Mn sulfide and Ca sulfide per unit area (1 mm$^2$) is defined as a total number density (/mm$^2$). Then, a total number density of Mn sulfide having an equivalent circular diameter of or more 1.0 μm and Ca sulfide having an equivalent circular diameter of 2.0 μm or more is defined as a total number density ND (Number Density). In this case, in the steel material of the present embodiment, the total number density ND of Mn sulfide having an equivalent circular diameter of 1.0 μm or more and Ca sulfide having an equivalent circular diameter of 2.0 μm or more is 0.50/mm$^2$ or less. That is, the total number of Mn sulfide having an equivalent circular diameter of 1.0 μm or more and Ca sulfide having an equivalent circular diameter of 2.0 μm or more is 0.50/mm$^2$ or less.

If the total number density ND of Mn sulfide having an equivalent circular diameter of 1.0 μm or more and Ca sulfide having an equivalent circular diameter of 2.0 μm or more is more than 0.50/mm$^2$, Mn sulfide and Ca sulfide in the surface layer of a steel material are likely to dissolve in a sour environment, and a depression which serves as a starting point for occurrence of SSC is likely to be formed on the surface of the steel material even if the content of each element in the chemical composition of the steel material is within the range of the present embodiment. For that reason, the SSC resistance of steel material deteriorates.

On the other hand, if the total number density ND of Mn sulfide having an equivalent circular diameter of 1.0 μm or more and Ca sulfide having an equivalent circular diameter of 2.0 μm or more is 0.50/mm$^2$ or less, the number density of Mn sulfide and Ca sulfide having a size which is likely to be dissolved in a sour environment is sufficiently low on the assumption that the content of each element in the chemical composition of the steel material is within the range of the present embodiment. For that reason, a depression is not likely to be formed on the surface of steel material even in a sour environment. As a result, the SSC resistance of steel material is sufficiently improved.

An upper limit of the total number density ND of Mn sulfide having an equivalent circular diameter of 1.0 μm or more and Ca sulfide having an equivalent circular diameter of 2.0 μm or more is preferably 0.48/mm$^2$, more preferably 0.47/mm$^2$, more preferably 0.46/mm$^2$, more preferably 0.45/mm$^2$, more preferably 0.44/mm$^2$, more preferably 0.43/mm$^2$, more preferably 0.42/mm$^2$.

[Measurement Method of Total Number Density ND]

The total number density ND of Mn sulfide having an equivalent circular diameter of 1.0 μm or more and Ca sulfide having an equivalent circular diameter of 2.0 μm or more can be measured by the following method. Specifically, a test specimen is taken from any position of steel material. When the steel material is a steel pipe, the test specimen is taken from a center position of the wall thickness. When the steel material is a steel bar having a circular cross section, the test specimen is taken from an R/2 position. Note that in the present specification, the term "R/2 position" means a center position of a radius R in a cross section perpendicular to the longitudinal direction of the steel bar. When the steel material is a steel plate, the test specimen is collected from a center position of the thickness.

The test specimen is embedded in resin. When the steel material is a steel pipe, a surface of the test specimen along the axial direction of the steel pipe and along the wall thickness direction of the steel pipe is determined as an observation surface. When the steel material is a steel bar, a surface of the test specimen along the axial direction of the steel bar and along the radius direction of the steel bar is determined as an observation surface. When the steel material is a steel plate, a surface of the test specimen along the longitudinal direction (rolling direction) of the steel plate and along the thickness direction of the steel plate is determined as an observation surface. The observation surface is polished. Arbitrary 10 visual fields in the observation surface after polishing are observed. In each visual field, the number of inclusions is determined. The area of each visual field is 36 mm$^2$ (6 mm×6 mm).

Specifically, element concentration analysis (EDS analysis) is conducted on each inclusion in each visual field to determine the particular kind of each inclusion. In the EDS analysis, the acceleration voltage is set to 20 kV, and the concentrations of elements N, O, Na, Mg, Al, Si, P, S, Cl, K, Ca, Ti, Cr, Mn, Fe, Cu, Zr and Nb are determined.

Based on the EDS analysis of each inclusion, whether an inclusion is Mn sulfide or Ca sulfide is identified. When an inclusion has, in mass %, a Mn content of 10% or more and a S content of 10% or more, the inclusion is identified as "Mn sulfide". When an inclusion has, in mass %, a Ca content of 20% or more, a S content of 10% or more, and a Mn content of less than 10%, the inclusion is identified as "Ca sulfide".

Among Mn sulfides identified in the 10 visual fields, a total number of Mn sulfide having an equivalent circular diameter of 1.0 μm or more is obtained. Further, among Ca sulfides measured in the 10 visual fields, a total number of Ca sulfide having an equivalent circular diameter of 2.0 μm or more is obtained. Based on the total number of Mn sulfide having an equivalent circular diameter of 1.0 μm or more, the total number of Ca sulfide having an equivalent circular diameter of 2.0 μm or more, and the total area of the 10 visual fields, a total number density ND (/mm$^2$) of Mn sulfide having an equivalent circular diameter of 1.0 μm or more and Ca sulfide having an equivalent circular diameter of 2.0 μm or more is obtained.

The measurement of the total number density ND can be carried out by use of an electron scanning microscope with a chemical composition analysis feature (so-called SEM-EDS). For example, an automatic inclusion analyzer "Metals Quality Analyzer" (product name) made by FEI (ASPEX) can be used as an SEM-EDS.

[Microstructure]

The microstructure of the steel material according to the present embodiment is mainly composed of martensite. In the present description, the term "martensite" includes not only fresh martensite but also tempered martensite. Moreover, in the present description, the phrase "mainly composed of martensite" means that the volume ratio of martensite is 80% or more in the microstructure. The balance of the microstructure is retained austenite. That is, the volume ratio of retained austenite is 0 to 20% in the steel material of the present embodiment. The volume ratio of retained austenite is preferably as low as possible. A lower limit of the volume ratio of martensite in the microstructure of steel material of the present embodiment is preferably 85%, and more preferably 90%. Further preferably, the microstructure of the steel material is of a martensite single phase.

In the microstructure, a small amount of retained austenite does not cause a significant decrease in strength and significantly increases the toughness of steel material. However, if the volume ratio of retained austenite is too high, the strength of steel material significantly decreases. Therefore, as described above, in the microstructure of the steel material of the present embodiment, the volume ratio of retained austenite is 0 to 20%. In view point of ensuring strength, an upper limit of the volume ratio of retained austenite is preferably 15%, and more preferably 10%. As described above, the microstructure of the steel material of the present embodiment may be of a martensite single phase. Therefore, the volume ratio of retained austenite may be 0%. On the other hand, when even a small amount of retained austenite is present, the volume ratio of retained austenite is more than 0 to 20%, more preferably more than 0 to 15%, and further preferably more than 0 to 10%.

[Measurement Method of Volume Ratio of Martensite]

The volume ratio (vol %) of martensite in the microstructure of the steel material of the present embodiment is obtained by subtracting the volume ratio (vol %) of retained austenite, which is obtained by the following method, from 100%.

The volume ratio of retained austenite is obtained by an X-ray diffraction method. Specifically, a test specimen is taken from any position of the steel material. When the steel material is a steel pipe, a test specimen is taken from a center position of the wall thickness. When the steel material is a steel bar, a test specimen is collected from an R/2 position. When the steel material is a steel plate, a test specimen is taken from a center position of the plate thickness. The size of the test specimen is not particularly limited. The test specimen is, for example, 15 mm×15 mm×a thickness of 2 mm. In this case, when the steel material is a steel pipe, the thickness direction of the test specimen is the steel pipe diameter direction. When the steel material is a steel bar, the thickness direction of the test specimen is the diameter direction of the steel bar. When the steel material is a steel plate, the thickness direction of the test specimen is the thickness direction of the steel plate. By using the obtained test specimen, X-ray diffraction intensity of each of the (200) plane of α phase, the (211) plane of α phase, the (200) plane of γ phase, the (220) plane of γ phase, and the (311) plane of γ phase is measured to calculate an integrated intensity of each plane. In the measurement of the X-ray diffraction intensity, the target of the X-ray diffraction apparatus is Mo (MoKα ray), and the output thereof is 50 kV-40 mA. After calculation, the volume ratio Vγ(%) of retained austenite is calculated using Formula (I) for combinations (2×3=6 pairs) of each plane of the α phase and each plane of the γ phase. Then, an average value of the volume ratios Vγ of retained austenite of the six pairs is defined as the volume ratio (%) of retained austenite.

$$V\gamma=100/\{1+(I\alpha\times R\gamma)/(I\gamma\times R\alpha)\} \quad \text{(I)}$$

Where, Iα is an integrated intensity of α phase. Rα is a crystallographic theoretical calculation value of α phase. Iγ is the integrated intensity of γ phase. Rγ is a crystallographic theoretical calculation value of γ phase. In the present description, Rα in the (200) plane of α phase is 15.9, Rα in the (211) plane of α phase is 29.2, and Rγ in the (200) plane of γ phase is 35.5, Rγ in the (220) plane of γ phase is 20.8, and Rγ in the (311) plane of γ phase is 21.8. Note that the volume ratio of retained austenite is obtained by rounding off the first decimal place of an obtained numerical value.

Using the volume ratio (%) of retained austenite obtained by the above described X-ray diffraction method, the volume ratio (vol %) of martensite of the microstructure of steel material is obtained by the following Formula.

Volume ratio of martensite=100−volume ratio of retained austenite (%)

[Yield Strength]

The yield strength of the steel material according to the present embodiment will not be particularly limited. The yield strength of the steel material is preferably 758 MPa or more (110 ksi or more), and more preferably 862 MPa or more (125 ksi or more). Although the upper limit of the yield strength is not particularly limited, an upper limit of the yield strength of the steel material of the present embodiment is, for example, less than 1069 MPa (less than 155 ksi). An upper limit of the yield strength of the steel material is more preferably 1000 MPa.

In the present description, the yield strength means 0.2% off-set proof stress (MPa) which is obtained by a tensile test at a normal temperature (24±3° C.) in conformity with ASTM E8/E8M (2013). Specifically, the yield strength is obtained by the following method. A tensile test specimen is taken from any position of a steel material. When the steel material is a steel pipe, a tensile test specimen is taken from a center position of the wall thickness. When the steel material is a steel bar, a tensile test specimen is taken from an R/2 position. When the steel material is a steel plate, a tensile test specimen is taken from a center position of the plate thickness. The size of the tensile test specimen is not particularly limited. The tensile test specimen is, for example, a round bar tensile test specimen having a parallel portion diameter of 8.9 mm and a parallel portion length of 35.6 mm. The longitudinal direction of the parallel portion of the tensile test specimen is parallel with the longitudinal direction (rolling direction) of the steel material. By using the tensile test specimen, a tensile test is conducted at a normal temperature (24±3° C.) in conformity with ASTM E8/E8M (2013) to obtain 0.2% off-set proof stress (MPa). The obtained 0.2% off-set proof stress is defined as yield strength (MPa).

[SSC Resistance of Steel Material]

The steel material according to the present embodiment has excellent SSC resistance. The SSC resistance of the steel material according to the present embodiment can be evaluated by SSC resistance evaluation test at a normal temperature. The SSC resistance evaluation test is conducted by a method in conformity with NACE TM0177-2005 Method A.

Specifically, a round bar test specimen is taken from the steel material of the present embodiment. When the steel material is a steel pipe, the round bar test specimen is taken from a center position of the wall thickness. When the steel material is a steel bar, the round bar test specimen is taken from an R/2 portion. When the steel material is a steel plate, the round bar test specimen is taken from a center position of the plate thickness. The size of the round bar test specimen is not particularly limited. The round bar test specimen has a size in which, for example, a parallel portion diameter is 6.35 mm and a parallel portion length is 25.4 mm. The longitudinal direction of the parallel portion of the round bar test specimen is parallel with the longitudinal direction (rolling direction) of the steel material.

The test solution is an aqueous solution containing 0.17 mass % of sodium chloride and having a pH of 3.0. The test solution is adjusted to pH 3.0 by adding acetic acid to an aqueous solution containing 0.17 mass % of sodium chloride and 0.41 g/L. of sodium acetate. Stress equivalent to 90% of the actual yield stress is applied to the round bar test specimen collected as described above. The test solution of 24° C. is poured into a test vessel such that the stressed round bar test specimen is immersed, thereby forming a test bath. After degassing the test bath, 0.03 bar $H_2S$ gas and 0.97 bar $CO_2$ gas are blown into the test bath to saturate the test bath with $H_2S$ gas. The test bath saturated with $H_2S$ gas is held at 24° C. for 720 hours. For the test specimen after being held for 720 hours, the surface of parallel portion of the specimen is observed with a loupe having a magnification of 10 times to confirm the presence or absence of a crack. When there is a place where a crack is suspected by the loupe observation, a cross section of the place where a crack is suspected is observed with an optical microscope having a magnification of 100 times to confirm the presence or absence of a crack.

[Shapes and Uses of Steel Material]

The steel material according to the present embodiment includes a steel pipe, a round steel bar (solid material), or a steel plate. The steel pipe may be either of a seamless steel pipe and a welded steel pipe. The steel pipe is, for example, a steel pipe for oil country tubular goods. The steel pipe for oil country tubular goods means a steel pipe to be used for oil country tubular goods. The oil country tubular goods include a casing pipe, a tubing pipe, a drilling pipe, and the like, which are used for drilling of an oil well or a gas well, collection of crude oil or natural gas, and the like. Preferably, the steel material of the present embodiment is a seamless steel pipe for oil country tubular goods.

As described so far, in the steel material of the present embodiment, each element of the chemical composition is within the range of the present embodiment, and the total number density of Mn sulfide having an equivalent circular diameter of 1.0 μm or more and Ca sulfide having an equivalent circular diameter of 2.0 μm or more is 0.50/mm$^2$ or less. As a result of that, the steel material of the present embodiment exhibits excellent SSC resistance.

[Production Method]

One example of a production method of a steel material of the present embodiment will be described. Note that the production method to be described below is an example, and the production method of a steel material of the present embodiment will not be limited thereto. That is, as long as a steel material of the present embodiment having the above described configuration can be produced, the production method will not be limited to the production method to be described below. However, the production method to be described below is a preferable production method for producing a steel material of the present embodiment.

One example of the production method of a steel material of the present embodiment includes a process (steel making process) of producing a starting material, a process (hot working process) of performing hot working of the starting material to produce an intermediate steel material, and a process (heat treatment process) of performing quenching and tempering of the intermediate steel material. Hereinafter, each step will be described.

[Steel Making Process]

The steel making process includes a process (refining process) of producing a molten steel, and a process (starting material production process) of producing a starting material by a casting process using the molten steel.

[Refining Process]

In the refining process, first, a molten steel containing Cr is accommodated in a ladle, and decarburization treatment is performed in the atmospheric pressure for the molten steel in the ladle (crude decarburization refining process). Slag is produced through the decarburization treatment in the crude decarburization refining process. The slag produced through the decarburization treatment floats to the liquid surface of the molten steel after the crude decarburization refining process. In the crude decarburization refining process, Cr in the molten steel is oxidized to form $Cr_2O_3$. The $Cr_2O_3$ is absorbed into the slag. Then, a deoxidizer is added to the ladle to reduce the $Cr_2O_3$ in the slag, thereby retrieving Cr in the molten steel (Cr reduction treatment process). The crude decarburization refining process and the Cr reduction treatment process are performed by, for example, an electric furnace process, a converter process, or AOD (Argon Oxygen Decarburization) process. After the Cr reduction treatment process, slag is removed from the molten steel (slag removing process).

In the case of a Cr containing steel, since the carbon activity decreases due to Cr, the decarburization reaction is suppressed. Accordingly, the molten steel after the slag removal process is subjected to finishing decarburization treatment (finish decarburization refining process). In the finish decarburization refining process, decarburization treatment is performed under reduced pressure. Performing the decarburization treatment under reduced pressure will result in decrease in the CO gas partial pressure ($P_{CO}$) in the atmosphere, and thereby oxidation of Cr in the molten steel is suppressed. For that reason, performing the decarburization treatment under reduced pressure will make it possible to further reduce the C concentration in the molten steel while suppressing the oxidation of Cr. After the finish decarburization refining process, the Cr reduction treatment, in which a deoxidizer is added to the molten steel to reduce $Cr_2O_3$ in the slag, is performed again (Cr reduction treatment process). The finish decarburization refining process and the Cr reduction treatment process after the finish decarburization refining process may be performed by, for example, a VOD (Vacuum Oxygen Decarburization) process, or RH (Ruhrstahl-Heraeus) process.

After the Cr reduction treatment process, final compositional adjustment for the molten steel in the ladle, and temperature adjustment of the molten steel before the starting material production process are performed (compositional adjustment process). The compositional adjustment process is performed by LT (Ladle Treatment). In the latter half of the compositional adjustment process, Ca is added to the molten steel. Here, a time from when Ca is added to the molten steel to when Ca is uniformly distributed in the molten steel is defined as a "uniform mixing time" $\tau$. The uniform mixing time $\tau$ is defined by the formula (A).

$$\tau=800\times\varepsilon^{-0.4} \quad (A)$$

Where, $\varepsilon$ is a stirring power density of the molten steel in LT and is defined by formula (B).

$$\varepsilon=28.5(Q/W)\times T\times\log(1+H/1.48) \quad (B)$$

Where, Q is a flow rate of top-blown gas ($Nm^3$/min). W is the molten steel mass (t). T is a temperature of the molten steel (K). H is the depth of the molten steel in the ladle (m).

In the compositional adjustment process, the molten steel temperature in the ladle is held at 1500 to 1700° C. Further, a holding time from when the uniform mixing time has elapsed after Ca is added to the molten steel is defined as "holding time t" (sec). In this case, in the present embodiment, the holding time t after elapse of the uniform mixing time is set to be 60 seconds or more.

When the holding time t is less than 60 seconds, Ca added to the molten steel cannot sufficiently reform Mn sulfide in the molten steel. In this case. Mn sulfide of a larger size will remain in the steel material. For that reason, the number per unit area of Mn sulfide having an equivalent circular diameter of 1.0 μm or more will become excessively large. As a result, a total number density ND (/$mm^2$) of Mn sulfide having an equivalent circular diameter of 1.0 μm or more and Ca sulfide having an equivalent circular diameter of 2.0 μm or more will become more than 0.50/$mm^2$. Alternatively, although Mn sulfide reacts with Ca, and goes on being reformed, the number per unit area of Mn sulfide having an equivalent circular diameter of 1.0 μm or more will decrease, Ca sulfide which is formed by combining with S will remain in the molten steel without being sufficiently absorbed in a slag. As a result, a total number density ND (/$mm^2$) of Mn sulfide having an equivalent circular diameter of 1.0 μm or more and Ca sulfide having an equivalent circular diameter of 2.0 μm or more will become more than 0.50/$mm^2$.

On the other hand, when the holding time t is not less than 60 seconds, Ca added to the molten steel sufficiently reforms Mn sulfide in the molten steel, thereby reducing large-sized Mn sulfide. For that reason, the number per unit area of Mn sulfide having an equivalent circular diameter of 1.0 μm or more will be sufficiently decreased. Further, it is possible to ensure sufficient time for large-sized Ca sulfide which has been produced by combining with S, to float up in the molten steel and be absorbed in the slag. For that reason, the number per unit area of Ca sulfide having an equivalent circular diameter of 2.0 μm or more will also become sufficiently small. As a result, the total number density ND (/$mm^2$) of Mn sulfide having an equivalent circular diameter of 1.0 μm or more and Ca sulfide having an equivalent circular diameter of 2.0 μm or more becomes 0.50/$mm^2$ or less.

As described so far, in the compositional adjustment process of the present embodiment, the holding time t after elapse of the uniform mixing time is preferably set to be 60 seconds or more. Note that in the compositional adjustment process of the present embodiment, an upper limit of the holding time t after elapse of the uniform mixing time is, although not particularly limited, for example, 3600 seconds.

[Starting Material Production Process]

By using the molten steel which has been produced by the above described refining process, a starting material (a cast piece or an ingot) is produced. Specifically by using the molten steel, a cast piece is produced by a continuous casting process. The cast piece may be a slab, a bloom, or a billet. Alternatively, an ingot may be produced by an ingot-making process using the molten steel. Further, the cast piece or the ingot may be subjected to blooming or the like to produce a billet. The starting material is produced by the above described processes.

[Hot Working Process]

In the hot working process, a starting material is subjected to hot working to produce an intermediate steel material. When the steel material is a steel pipe, the intermediate steel material corresponds to a hollow shell. First, the starting material is heated in a heating furnace. The heating temperature is, although not particularly limited, for example, 1100 to 1300° C. The billet extracted from the heating furnace is subjected to hot working to produce a hollow shell (seamless steel pipe) which is the intermediate steel material. The method of hot working is not particularly limited and may be any known method. For example, the Mannesmann process is performed as the hot working to produce a hollow shell. In this case, a round billet is subjected to piercing-rolling by a piercing machine. When performing piercing-rolling, piercing ratio is, although not particularly limited, for example, 1.0 to 4.0. The piercing-rolled round billet is further subjected to hot working by means of, for example, a mandrel mill, a reducer, a sizing mill, and the like to form a hollow shell. A cumulative reduction of area in the hot working step is, for example, 20 to 70%.

The hollow shell may be produced from a billet by another hot working method. For example, in the case of a short-sized, thick-wall steel material like a coupling, the hollow shell may be produced by forging such as the Erhard method etc. The hollow shell is produced by the above described processes.

When the steel material is a steel bar, first, the starting material is heated in a heating furnace. The heating temperature is, although not particularly limited, for example, 1100 to 1300° C. The starting material extracted from the heating furnace is subjected to hot working to produce a steel bar which is the intermediate steel material. The hot working is, for example, blooming by a blooming mill, or hot rolling by a continuous rolling mill. The continuous rolling mill is configured such that a horizontal stand having a pair of grooved rolls aligned in the vertical direction, and a vertical stand having a pair of grooved rolls aligned in the horizontal direction are arranged in an alternating manner.

When the steel material is a steel plate, first, the starting material is heated in a heating furnace. The heating temperature is, although not particularly limited, for example, 1100 to 1300° C. The starting material extracted from the heating furnace is subjected to hot rolling by means of a blooming mill and a continuous rolling mill to produce a steel plate which is the intermediate steel material.

The intermediate steel material produced by hot working may be air-cooled (As Rolled). The intermediate steel material produced by hot working may be subjected to direct quenching after hot working instead of being air-cooled to a normal temperature, or may be subjected to quenching after supplementary heating (reheating) after hot working.

When direct quenching is performed after hot working, or quenching is performed after hot working and thereafter supplementary heating are performed, stress relief annealing (SR treatment) may be performed before the heat treatment process (quenching and tempering) in the subsequent process in order to relieve residual stress.

[Heat Treatment Process]

The heat treatment process includes a quenching process and a tempering process.

[Quenching Process]

In the heat treatment process, first, the intermediate steel material produced in the hot working process is subjected to quenching (quenching process). Quenching is carried out in a well-known method. Specifically, the intermediate steel material after hot working process is loaded into a heat treatment furnace and is held at a quenching temperature. The quenching temperature is not lower than the $A_{C3}$ transformation point and is, for example, 900 to 1000° C. After holding the intermediate steel material at the quenching temperature, it is rapidly cooled (quenched). The holding time at the quenching temperature is, although not particularly limited, for example, 10 to 60 minutes. The quenching method is, for example, water cooling. The quenching method is not particularly limited. When the intermediate steel material is a hollow shell, the hollow shell may be rapidly cooled by immersing it in a water bath or oil bath, or the hollow shell may be rapidly cooled by pouring or jetting cooling water to the outer surface and/or the inner surface of the hollow shell by means of shower cooling or mist cooling.

Note that, as described so far, quenching (direct quenching) may be performed immediately after hot working without cooling the intermediate steel material to a normal temperature after the hot working process, or quenching may be performed after holding the hollow shell at a quenching temperature by loading it into a supplementary heating furnace before the temperature of the hollow shell after hot working declines.

[Tempering Process]

The intermediate steel material after quenching is further subjected to a tempering process. In the tempering process, the yield strength of the steel material is adjusted. In the present embodiment, the tempering temperature is set to 540 to 620° C. The holding time at the tempering temperature is, although not particularly limited, for example, 10 to 180 minutes. It is well known to those skilled in the art that the yield strength of the steel material can be adjusted by appropriately adjusting the tempering temperature depending on the chemical composition. Preferably, the tempering condition is adjusted such that the yield strength of the steel material is 758 MPa or more (110 ksi or more).

The steel material of the present embodiment can be produced by the above described processes. The production method will not be limited to the production method of the steel material of the present embodiment. As long as a steel material, in which the content of each element in the chemical composition is within the range of the present embodiment, and in which the total number density ND (/mm$^2$) of Mn sulfide having an equivalent circular diameter of 1.0 μm or more and Ca sulfide having an equivalent circular diameter of 2.0 μm or more is 0.50/mm$^2$ or less, can be produced, the production method of the steel material of the present embodiment will not be limited to the above described production method.

EXAMPLES

Example 1

In Example 1, SSC resistance in steel materials having a yield strength 125 ksi or more (yield strength was 862 MPa or more) was investigated. Specifically, molten steels having chemical compositions shown in Table 1 were produced.

TABLE 1

| Test | Chemical composition (in mass %, with the balance being Fe and impurities) | | | | | | | | | | | |
|---|---|---|---|---|---|---|---|---|---|---|---|---|
| No. | C | Si | Mn | P | S | sol. Al | N | Ni | Cr | Cu | Mo | V |
| 1 | 0.016 | 0.45 | 0.43 | 0.020 | 0.0009 | 0.024 | 0.006 | 6.93 | 12.67 | 0.44 | 2.96 | 0.03 |
| 2 | 0.014 | 0.49 | 0.43 | 0.017 | 0.0008 | 0.029 | 0.006 | 6.74 | 12.19 | 0.25 | 2.70 | 0.06 |
| 3 | 0.024 | 0.43 | 0.31 | 0.018 | 0.0009 | 0.026 | 0.009 | 6.64 | 12.67 | 0.40 | 3.12 | 0.03 |
| 4 | 0.010 | 0.49 | 0.36 | 0.019 | 0.0009 | 0.034 | 0.008 | 6.60 | 11.86 | 0.38 | 2.69 | 0.05 |
| 5 | 0.016 | 0.31 | 0.37 | 0.014 | 0.0009 | 0.028 | 0.009 | 6.81 | 11.83 | 0.45 | 2.72 | 0.03 |
| 6 | 0.009 | 0.43 | 0.40 | 0.015 | 0.0008 | 0.020 | 0.010 | 6.54 | 12.61 | 0.60 | 3.03 | 0.05 |
| 7 | 0.011 | 0.46 | 0.33 | 0.011 | 0.0006 | 0.034 | 0.007 | 6.70 | 12.17 | 0.31 | 2.87 | 0.05 |
| 8 | 0.032 | 0.29 | 0.39 | 0.015 | 0.0008 | 0.045 | 0.005 | 6.71 | 12.13 | 0.06 | 3.18 | 0.06 |
| 9 | 0.008 | 0.34 | 0.43 | 0.012 | 0.0007 | 0.023 | 0.006 | 6.67 | 12.24 | 0.27 | 2.94 | 0.03 |
| 10 | 0.017 | 0.37 | 0.28 | 0.014 | 0.0005 | 0.023 | 0.008 | 7.16 | 12.62 | 0.40 | 2.73 | 0.03 |
| 11 | 0.017 | 0.31 | 0.25 | 0.017 | 0.0006 | 0.032 | 0.010 | 6.84 | 11.95 | 0.50 | 2.77 | 0.06 |
| 12 | 0.015 | 0.45 | 0.29 | 0.015 | 0.0008 | 0.031 | 0.010 | 6.73 | 11.82 | 0.32 | 3.02 | 0.03 |
| 13 | 0.009 | 0.34 | 0.45 | 0.019 | 0.0007 | 0.029 | 0.010 | 7.26 | 12.26 | 0.42 | 3.11 | 0.04 |
| 14 | 0.027 | 0.34 | 0.38 | 0.009 | 0.0015 | 0.034 | 0.005 | 6.64 | 12.72 | 0.12 | 3.04 | 0.06 |
| 15 | 0.012 | 0.39 | 0.36 | 0.011 | 0.0006 | 0.034 | 0.010 | 7.09 | 12.37 | 0.34 | 2.94 | 0.05 |
| 16 | 0.018 | 0.48 | 0.41 | 0.012 | 0.0006 | 0.037 | 0.008 | 7.13 | 12.23 | 0.36 | 3.04 | 0.03 |
| 17 | 0.013 | 0.40 | 0.44 | 0.008 | 0.0055 | 0.030 | 0.008 | 7.13 | 12.22 | 0.44 | 2.86 | 0.06 |
| 18 | 0.019 | 0.33 | 0.30 | 0.013 | 0.0059 | 0.038 | 0.006 | 7.05 | 12.44 | 0.40 | 3.04 | 0.05 |
| 19 | 0.010 | 0.36 | 0.33 | 0.006 | 0.0010 | 0.022 | 0.008 | 7.46 | 11.81 | 0.41 | 2.94 | 0.06 |
| 20 | 0.015 | 0.49 | 0.24 | 0.014 | 0.0010 | 0.045 | 0.009 | 7.18 | 12.56 | 0.36 | 2.72 | 0.06 |
| 21 | 0.013 | 0.31 | 0.39 | 0.011 | 0.0009 | 0.024 | 0.006 | 6.81 | 12.04 | 0.43 | 2.73 | 0.06 |
| 22 | 0.012 | 0.35 | 0.31 | 0.008 | 0.0007 | 0.035 | 0.007 | 6.59 | 11.82 | 0.01 | 2.95 | 0.06 |
| 23 | 0.014 | 0.35 | 0.27 | 0.015 | 0.0005 | 0.019 | 0.007 | 7.22 | 12.99 | 0.76 | 2.85 | 0.04 |

TABLE 1-continued

| Test No. | Chemical composition (in mass %, with the balance being Fe and impurities) | | | | | | | | |
|---|---|---|---|---|---|---|---|---|---|
| | Ti | Co | Ca | O | W | Nb | B | Mg | REM |
| 1 | 0.20 | 0.15 | 0.0019 | 0.0003 | — | — | — | — | — |
| 2 | 0.24 | 0.22 | 0.0005 | 0.0026 | — | — | — | — | — |
| 3 | 0.13 | 0.42 | 0.0009 | 0.0038 | — | — | — | — | — |
| 4 | 0.09 | 0.26 | 0.0008 | 0.0040 | — | — | — | — | — |
| 5 | 0.21 | 0.32 | 0.0005 | 0.0038 | — | — | — | — | — |
| 6 | 0.12 | 0.35 | 0.0022 | 0.0002 | — | — | — | — | — |
| 7 | 0.22 | 0.11 | 0.0019 | 0.0029 | — | — | — | — | — |
| 8 | 0.14 | 0.22 | 0.0010 | 0.0008 | — | — | — | — | — |
| 9 | 0.20 | 0.14 | 0.0003 | 0.0030 | 1.01 | — | — | — | — |
| 10 | 0.19 | 0.15 | 0.0015 | 0.0009 | — | 0.27 | — | — | — |
| 11 | 0.08 | 0.14 | 0.0018 | 0.0038 | — | — | 0.0007 | — | — |
| 12 | 0.15 | 0.35 | 0.0030 | 0.0019 | — | — | — | 0.0007 | — |
| 13 | 0.23 | 0.48 | 0.0018 | 0.0012 | — | — | — | — | 0.011 |
| 14 | 0.09 | 0.17 | 0.0015 | 0.0007 | 1.25 | 0.32 | — | — | — |
| 15 | 0.23 | 0.19 | 0.0028 | 0.0029 | 0.98 | — | — | 0.0007 | — |
| 16 | 0.06 | 0.15 | 0.0017 | 0.0024 | — | 0.30 | 0.0009 | — | 0.015 |
| 17 | 0.17 | 0.41 | 0.0019 | 0.0003 | — | — | — | — | — |
| 18 | 0.23 | 0.23 | 0.0017 | 0.0027 | — | — | — | — | — |
| 19 | 0.14 | 0.18 | 0.0002 | 0.0038 | — | — | — | — | — |
| 20 | 0.22 | 0.22 | 0.0052 | 0.0023 | — | — | — | — | — |
| 21 | 0.08 | 0.18 | 0.0010 | 0.0012 | — | — | — | — | — |
| 22 | 0.20 | 0.34 | 0.0016 | 0.0020 | — | — | — | — | — |
| 23 | 0.09 | 0.25 | 0.0014 | 0.0013 | — | — | — | — | — |

The symbol "-" in Table 1 means that the content of a corresponding element was less than a detection limit. For example, the W content of Test No. 1 was 0% as a result of rounding off the third decimal place. The Nb content of Test No. 1 was 0% as a result of rounding off the third decimal place. The B content of Test No. 1 was 0% as a result of rounding off the fifth decimal place. The Mg content of Test No. 1 was 0% as a result of rounding off the fifth decimal place. The REM content of Test No. 1 was 0% as a result of rounding off the fourth decimal place.

Molten steels of Test Nos. 1 to 23 were produced in the following manner. A molten steel containing Cr was accommodated in a ladle, and was subjected to the well-known crude decarburization refining process and the Cr reduction treatment process by the AOD process. After the Cr reduction treatment process, a slag removing process for removing slag from the molten steel was conducted. Further, the well-known finish decarburization refining process and the Cr reduction treatment process were conducted by the VOD process.

After the Cr reduction treatment process by the VOD process, by means of the LT, final compositional adjustment for the molten steel in the ladle, and temperature adjustment of the molten steel before the starting material production process were performed. The temperature of any molten steel was 1500 to 1700° C. Further, Ca was added to the molten steel. The holding time t (sec) from when the uniform mixing time elapsed after Ca was added was adjusted as shown in Table 2. Molten steels having the chemical compositions shown in Table 1 were produced by the above described processes.

TABLE 2

| Test No. | LT process Holding time t (second) | Martensite volume ratio (%) | Total number density ND ($/mm^2$) | YS (MPa) | SSC resistance |
|---|---|---|---|---|---|
| 1 | 128 | 98 | 0.44 | 965 | E |
| 2 | 161 | 94 | 0.39 | 903 | E |
| 3 | 173 | 95 | 0.28 | 917 | E |
| 4 | 148 | 95 | 0.36 | 986 | E |
| 5 | 118 | 96 | 0.36 | 931 | E |
| 6 | 148 | 94 | 0.33 | 876 | E |
| 7 | 170 | 94 | 0.30 | 972 | E |
| 8 | 91 | 96 | 0.36 | 980 | E |
| 9 | 177 | 97 | 0.36 | 889 | E |
| 10 | 153 | 97 | 0.31 | 931 | E |
| 11 | 162 | 94 | 0.31 | 951 | E |
| 12 | 114 | 96 | 0.44 | 938 | E |
| 13 | 175 | 94 | 0.30 | 986 | E |
| 14 | 77 | 98 | 0.44 | 992 | E |
| 15 | 180 | 94 | 0.22 | 889 | E |
| 16 | 130 | 96 | 0.31 | 876 | E |
| 17 | 136 | 97 | 1.52 | 986 | B |
| 18 | 143 | 95 | 1.22 | 993 | B |
| 19 | 146 | 94 | 0.56 | 965 | B |
| 20 | 136 | 98 | 0.81 | 903 | B |
| 21 | 48 | 96 | 0.73 | 938 | B |
| 22 | 56 | 98 | 0.80 | 993 | B |
| 23 | 39 | 97 | 0.64 | 990 | B |

By using the molten steels of Test Nos. 1 to 23, a billet having an outer diameter of 310 mm was produced. The produced billet was heated to 1250° C. and thereafter subjected to hot rolling by the Mannesmann process to produce a hollow shell (seamless steel pipe) having an outer diameter of 244.48 mm and a wall thickness of 13.84 mm.

The hollow shells of Test Nos. 1 to 23 were subjected to quenching and tempering. For any of the hollow shells of Test Nos. 1 to 23, the quenching temperature was 920° C. and the holding time at the quenching temperature was 10 minutes. The hollow shells of Test Nos. 1 to 23 after quenching were subjected to tempering. The tempering temperature was adjusted in a range of 540 to 580° C. for each test number such that the yield strength of the steel material (seamless steel pipe) after tempering was 862 MPa or more. The holding time at the tempering temperature was 30 minutes for any test number.

By the production processes described above, steel materials (seamless steel pipes) of Test Nos. 1 to 23 were produced.

[Evaluation Test]

For the steel materials of Test Nos. 1 to 23 after tempering, a microstructure observation test, a total number density ND measurement test, a tensile test, and an SSC resistance evaluation test were conducted.

[Measurement Test of Martensite Volume Ratio in Microstructure]

The volume ratio of martensite in the microstructure of the steel materials (seamless steel pipes) of Test Nos. 1 to 23 was obtained by the following method. First, the volume ratio of retained austenite in the microstructure of the steel material of each test number was obtained by an X-ray diffraction method. Specifically, a test specimen was taken from a center position of the wall thickness of the steel material (seamless steel pipe) of each test number. The size of the test specimen was 15 mm×15 mm×a thickness of 2 mm. The thickness direction of the test specimen corresponded to the steel pipe diameter direction. By using the obtained test specimen, X-ray diffraction intensity of each of the (200) plane of α phase, the (211) plane of α phase, the (200) plane of γ phase, the (220) plane of γ phase, and the (311) plane of γ phase was measured to calculate an integrated intensity of each plane. In the measurement of the X-ray diffraction intensity, the target of the X-ray diffraction apparatus was Mo (MoKα ray), and the output thereof was 50 kV-40 mA. After calculation, the volume ratio Vγ(%) of retained austenite was calculated using Formula (I) for combinations (2×3=6 pairs) of each plane of the a phase and each plane of the γ phase. Then, an average value of the volume ratios Vγ of retained austenite of the six pairs was defined as the volume ratio (%) of retained austenite.

$$V\gamma=100/\{1+(I\alpha\times R\gamma)/(I\gamma\times R\alpha)\} \quad (I)$$

Where, Iα is an integrated intensity of α phase. Rα is a crystallographic theoretical calculation value of α phase. Iγ is an integrated intensity of γ phase. Rγ is a crystallographic theoretical calculation value of γ phase. In the present description, Rα in the (200) plane of α phase is 15.9, Rα in the (211) plane of α phase is 29.2, Rγ in the (200) plane of γ phase is 35.5, Rγ in the (220) plane of γ phase is 20.8, and Rγ in the (311) plane of γ phase is 21.8. Note that the volume ratio of retained austenite was obtained by rounding off the first decimal place of an obtained numerical value.

Using the volume ratio (%) of retained austenite obtained by the above described X-ray diffraction method, the volume ratio (vol. %) of martensite of the microstructure of steel materials of Test Nos. 1 to 23 was obtained by the following Formula.

Volume ratio of martensite=100−volume ratio of retained austenite (%)

Obtained martensite volume ratios of Test Nos. 1 to 23 are shown in the "Martensite volume ratio (%)" column in Table 2.

[Measurement Test of Total Number Density ND]

The total number density ND of Mn sulfide having an equivalent circular diameter of 1.0 μm or more and Ca sulfide having an equivalent circular diameter of 2.0 μm or more in the steel materials (seamless steel pipes) of Test Nos. 1 to 23 was measured by the following method. A test specimen was taken from a center position of the wall thickness of the steel material of each test number. The test specimen was embedded in resin. A surface of the test specimen along the axial direction of the steel pipe and along the wall thickness direction of the steel pipe was determined as an observation surface. The observation surface of the steel material embedded in resin was polished. Arbitrary 10 visual fields in the observation surface after polishing were observed. In each visual field, the number of inclusions was determined. The area of each visual field was 36 $mm^2$ (6 mm×6 mm).

Element concentration analysis (EDS analysis) was conducted on each inclusion in each visual field to determine the particular kind of each inclusion. In the EDS analysis, the acceleration voltage was set to 20 kV, and the concentrations of elements N, O, Na, Mg, Al, Si, P, S, Cl, K, Ca, Ti, Cr, Mn, Fe, Cu, Zr and Nb were determined.

Based on the EDS analysis of each inclusion, whether an inclusion was Mn sulfide or Ca sulfide was identified. When an inclusion has, in mass %, a Mn content of 10% or more and a S content of 10% or more, the inclusion was identified as "Mn sulfide". When an inclusion has, in mass %, a Ca content of 20% or more, a S content of 10% or more, and a Mn content of less than 10%, the inclusion was identified as "Ca sulfide".

Among Mn sulfide identified in each field of view, a total number of Mn sulfide having an equivalent circular diameter of 1.0 μm or more was obtained. Further, among Ca sulfide measured in each field of view, a total number of Ca sulfide having an equivalent circular diameter of 2.0 μm or more was obtained. Based on the total number of Mn sulfide having an equivalent circular diameter of 1.0 μm or more, the total number of Ca sulfide having an equivalent circular diameter of 2.0 μm or more, and the total area of the 10 fields of view, a total number density ND (/$mm^2$) of Mn sulfide having an equivalent circular diameter of 1.0 μm or more and Ca sulfide having an equivalent circular diameter of 2.0 μm or more was obtained. Note that the measurement of the total number density ND was carried out by use of the automatic inclusion analyzer "Metals Quality Analyzer" (product name) made by FEI (ASPEX). Obtained the total number densities ND of Test Nos. 1 to 23 are shown in the "Total number density ND (/$mm_2$)" column of Table 2.

[Tensile Test]

For the steel materials (seamless steel pipes) of Test Nos. 1 to 23, a tensile test was conducted in conformity with ASTM E8/E8M (2013). Specifically, a round bar tensile test specimen was taken from a center position of the wall thickness of the steel material of each test number. The round bar tensile test specimen had a parallel portion diameter of 8.9 mm and a parallel portion length of 35.6 mm. The longitudinal direction of the round bar tensile test specimen was parallel to the longitudinal direction (rolling direction) of the steel material. Using the round bar tensile test specimens of Test Nos. 1 to 23, a tensile test was conducted at a normal temperature (25° C.) in the atmosphere to obtain 0.2% off-set proof stress (MPa). The obtained 0.2% off-set proof stress was defined as yield strength (MPa). Obtained yield strengths of Test Nos. Ito 23 are shown in the "YS (MPa)" column of Table 2.

[SSC Resistance Evaluation Test]

An SSC resistance evaluation test of the steel materials (seamless steel pipes) of Test Nos. 1 to 23 was conducted by the following method. A round bar test specimen was taken from a center position of the wall thickness of the steel material of each test number. The round bar test specimen had a parallel portion diameter of 6.35 mm and a parallel portion length of 25.4 mm. The longitudinal direction of the round bar test specimen was parallel to the longitudinal direction (pipe axis direction) of the steel material.

The test solution was an aqueous solution containing 0.17 mass % of sodium chloride and having a pH of 3.0. The test solution was adjusted to pH 3.0 by adding acetic acid to an aqueous solution containing 0.17 mass % of sodium chloride and 0.41 g/L of sodium acetate. Stress equivalent to 90% of the actual yield stress was applied to the round bar test specimen. The test solution of 24° C. was poured into a test vessel such that the stressed round bar test specimen was immersed, thereby forming a test bath. After degassing the test bath, 0.03 bar $H_2S$ gas and 0.97 bar $CO_2$ gas were blown into the test bath to saturate the test bath with $H_2S$ gas. The test bath saturated with $H_2S$ gas was held at 24° C. for 720 hours. The surface of the parallel portion of the round bar test specimen after being held for 720 hours was observed with a loupe having a magnification of 10 times to confirm the presence or absence of a crack. When there was a place where a crack was suspected by loupe observation, a cross section of the place where a crack was suspected was observed with an optical microscope of a magnification of 100 times to confirm the presence or absence of a crack.

When no crack was observed even when the surface of the round bar test specimen was observed with a loupe of 10 times and an optical microscope of 100 times, it was judged that excellent SSC resistance was achieved (denoted as "E (Excellent)" in the "SSC resistance" column in Table 2). When any crack was confirmed, it was judged that excellent SSC resistance was not achieved (denoted as "B (Bad)" in the "SSC resistance" column in Table 2).

[Evaluation Results]

Referring to Tables 1 and 2, the steel materials of Test Nos. 1 to 16 had appropriate chemical compositions. Further, the martensite volume ratio in the microstructure was 80% or more, and the yield strength was 862 MPa or more (125 ksi or more). Further, the total number density ND of Mn sulfide having an equivalent circular diameter of 1.0 μm or more and Ca sulfide having an equivalent circular diameter of 2.0 μm or more was 0.50/mm$^2$ or less. As a result of that, in the steel materials of Test Nos. 1 to 16, excellent SSC resistance was achieved.

On the other hand, in Test Nos. 17 and 18, the S content was too high in the chemical composition of the steel material. As a result of that, the total number density ND of Mn sulfide having an equivalent circular diameter of 1.0 μm or more and Ca sulfide having an equivalent circular diameter of 2.0 μm or more was more than 0.50/mm$^2$. As a result, in the steel materials of Test Nos. 17 and 18, excellent SSC resistance was not achieved.

In Test No. 19, the Ca content was too low in the chemical composition of the steel material. As a result of that, the total number density ND of Mn sulfide having an equivalent circular diameter of 1.0 μm or more and Ca sulfide having an equivalent circular diameter of 2.0 μm or more was more than 0.50/mm$^2$. As a result, in the steel material of Test No. 19, excellent SSC resistance was not achieved.

In Test No. 20, the Ca content was too high in the chemical composition of the steel material. As a result of that, the total number density ND of Mn sulfide having an equivalent circular diameter of 1.0 μm or more and Ca sulfide having an equivalent circular diameter of 2.0 μm or more was more than 0.50/mm$^2$. As a result, in the steel material of Test No. 20, excellent SSC resistance was not achieved.

In Test Nos. 21 to 23, the holding time t after elapse of uniform mixing time was too short in the production process of the steel material. As a result of that, the total number density ND of Mn sulfide having an equivalent circular diameter of 1.0 μm or more and Ca sulfide having an equivalent circular diameter of 2.0 μm or more was more than 0.50/mm$^2$. As a result, in the steel materials of Test Nos. 21 to 23, excellent SSC resistance was not achieved.

Example 2

In Example 2, SSC resistance in steel materials having a yield strength of 110 ksi grade (yield strength was 758 MPa to less than 862 MPa) was investigated. Specifically, molten steels having chemical compositions shown in Table 3 were produced. The symbol "-" 2 in Table 3 means that the content of a corresponding element was less than a detection limit as in Table 1 according to Example 1.

TABLE 3

| Test | Chemical composition (in mass %, with the balance being Fe and impurities) | | | | | | | | | | | |
|---|---|---|---|---|---|---|---|---|---|---|---|---|
| No. | C | Si | Mn | P | S | sol. Al | N | Ni | Cr | Cu | Mo | V |
| 24 | 0.011 | 0.30 | 0.42 | 0.017 | 0.0010 | 0.043 | 0.010 | 5.83 | 11.82 | 0.62 | 2.23 | 0.04 |
| 25 | 0.021 | 0.41 | 0.35 | 0.013 | 0.0008 | 0.023 | 0.007 | 5.69 | 12.59 | 0.74 | 1.81 | 0.06 |
| 26 | 0.011 | 0.49 | 0.26 | 0.008 | 0.0008 | 0.044 | 0.007 | 5.81 | 12.93 | 0.15 | 2.06 | 0.03 |
| 27 | 0.009 | 0.50 | 0.33 | 0.007 | 0.0005 | 0.034 | 0.006 | 6.04 | 12.21 | 0.26 | 2.03 | 0.03 |
| 28 | 0.014 | 0.35 | 0.34 | 0.006 | 0.0007 | 0.037 | 0.007 | 6.10 | 12.72 | 0.25 | 2.11 | 0.03 |
| 29 | 0.015 | 0.43 | 0.35 | 0.006 | 0.0009 | 0.024 | 0.007 | 6.05 | 12.14 | 0.33 | 1.94 | 0.04 |
| 30 | 0.018 | 0.31 | 0.45 | 0.011 | 0.0009 | 0.035 | 0.006 | 5.44 | 11.99 | 0.48 | 2.08 | 0.06 |
| 31 | 0.022 | 0.35 | 0.33 | 0.015 | 0.0007 | 0.024 | 0.006 | 5.37 | 12.31 | 0.10 | 2.36 | 0.05 |
| 32 | 0.012 | 0.39 | 0.39 | 0.014 | 0.0008 | 0.031 | 0.006 | 5.48 | 11.98 | 0.15 | 2.19 | 0.05 |
| 33 | 0.021 | 0.48 | 0.36 | 0.018 | 0.0010 | 0.031 | 0.010 | 5.25 | 11.81 | 0.77 | 2.39 | 0.03 |
| 34 | 0.014 | 0.32 | 0.28 | 0.020 | 0.0008 | 0.021 | 0.009 | 6.06 | 12.75 | 0.79 | 2.17 | 0.05 |
| 35 | 0.012 | 0.33 | 0.34 | 0.007 | 0.0005 | 0.029 | 0.007 | 6.15 | 12.26 | 0.68 | 1.83 | 0.03 |
| 36 | 0.013 | 0.42 | 0.35 | 0.010 | 0.0010 | 0.025 | 0.008 | 5.62 | 11.97 | 0.27 | 1.91 | 0.05 |

TABLE 3-continued

| | | | | | | | | | | | | |
|---|---|---|---|---|---|---|---|---|---|---|---|---|
| 37 | 0.018 | 0.40 | 0.33 | 0.020 | 0.0010 | 0.045 | 0.009 | 6.08 | 12.84 | 0.54 | 2.36 | 0.06 |
| 38 | 0.010 | 0.46 | 0.40 | 0.011 | 0.0006 | 0.025 | 0.007 | 6.22 | 12.12 | 0.20 | 1.94 | 0.03 |
| 39 | 0.011 | 0.45 | 0.44 | 0.009 | 0.0007 | 0.029 | 0.006 | 6.18 | 12.66 | 0.69 | 1.91 | 0.04 |
| 40 | 0.011 | 0.47 | 0.34 | 0.015 | 0.0008 | 0.038 | 0.007 | 5.52 | 12.99 | 0.41 | 2.02 | 0.04 |
| 41 | 0.013 | 0.34 | 0.39 | 0.015 | 0.0055 | 0.021 | 0.009 | 6.04 | 11.87 | 0.17 | 2.06 | 0.06 |
| 42 | 0.011 | 0.32 | 0.27 | 0.016 | 0.0059 | 0.020 | 0.009 | 5.45 | 12.12 | 0.48 | 2.35 | 0.03 |
| 43 | 0.011 | 0.38 | 0.40 | 0.019 | 0.0005 | 0.022 | 0.008 | 5.51 | 12.52 | 0.23 | 2.32 | 0.03 |
| 44 | 0.021 | 0.44 | 0.41 | 0.019 | 0.0008 | 0.039 | 0.006 | 5.89 | 12.22 | 0.34 | 1.88 | 0.06 |
| 45 | 0.023 | 0.45 | 0.42 | 0.014 | 0.0006 | 0.037 | 0.008 | 6.05 | 12.20 | 0.66 | 2.11 | 0.06 |
| 46 | 0.010 | 0.47 | 0.34 | 0.013 | 0.0009 | 0.021 | 0.008 | 5.56 | 12.06 | 0.59 | 2.12 | 0.04 |

| Test | Chemical composition (in mass %, with the balance being Fe and impurities) | | | | | | | | |
|---|---|---|---|---|---|---|---|---|---|
| No. | Ti | Co | Ca | O | W | Nb | B | Mg | REM |
| 24 | 0.10 | 0.48 | 0.0027 | 0.0039 | — | — | — | — | — |
| 25 | 0.08 | 0.27 | 0.0017 | 0.0005 | — | — | — | — | — |
| 26 | 0.09 | 0.30 | 0.0019 | 0.0007 | — | — | — | — | — |
| 27 | 0.12 | 0.25 | 0.0023 | 0.0039 | — | — | — | — | — |
| 28 | 0.09 | 0.17 | 0.0008 | 0.0027 | — | — | — | — | — |
| 29 | 0.13 | 0.31 | 0.0006 | 0.0028 | — | — | — | — | — |
| 30 | 0.20 | 0.28 | 0.0009 | 0.0040 | — | — | — | — | — |
| 31 | 0.12 | 0.18 | 0.0019 | 0.0014 | — | — | — | — | — |
| 32 | 0.25 | 0.24 | 0.0018 | 0.0016 | — | — | — | — | — |
| 33 | 0.09 | 0.26 | 0.0011 | 0.0012 | 0.81 | — | — | — | — |
| 34 | 0.14 | 0.37 | 0.0030 | 0.0004 | — | 0.48 | — | — | — |
| 35 | 0.13 | 0.48 | 0.0019 | 0.0010 | — | — | 0.0012 | — | — |
| 36 | 0.10 | 0.47 | 0.0013 | 0.0018 | — | — | — | 0.0008 | — |
| 37 | 0.11 | 0.20 | 0.0004 | 0.0024 | — | — | — | — | 0.013 |
| 38 | 0.16 | 0.23 | 0.0016 | 0.0018 | 0.25 | 0.12 | — | — | — |
| 39 | 0.16 | 0.34 | 0.0006 | 0.0003 | 1.12 | — | — | 0.0008 | — |
| 40 | 0.06 | 0.37 | 0.0024 | 0.0036 | — | 0.22 | 0.0005 | — | 0.012 |
| 41 | 0.16 | 0.34 | 0.0007 | 0.0025 | — | — | — | — | — |
| 42 | 0.24 | 0.18 | 0.0024 | 0.0022 | — | — | — | — | — |
| 43 | 0.17 | 0.30 | 0.0002 | 0.0024 | — | — | — | — | — |
| 44 | 0.09 | 0.13 | 0.0052 | 0.0030 | — | — | — | — | — |
| 45 | 0.24 | 0.44 | 0.0029 | 0.0003 | — | — | — | — | — |
| 46 | 0.14 | 0.17 | 0.0030 | 0.0029 | — | — | — | — | — |

Molten steels of Test Nos. 24 to 46 were produced in the following manner as in the molten steels of Test Nos. 1 to 23 of Example 1. A molten steel containing Cr was accommodated in a ladle, and the well-known crude decarburization refining process and the Cr reduction treatment process were conducted by the AOD process. After the Cr reduction treatment process, a slag removing process for removing slag from the molten steel was conducted. Further, the well-known finish decarburization refining process and Cr reduction treatment process were conducted by the VOD process.

After the Cr reduction treatment process by the VOD process, by means of the LT, final compositional adjustment for the molten steel in the ladle, and temperature adjustment of the molten steel before the starting material production process were performed. The temperature of any molten steel was 1500 to 1700° C. Further, Ca was added to the molten steel. The holding time t (second) from when the uniform mixing time elapsed after Ca was added was adjusted as shown in Table 4. Molten steels having the chemical compositions shown in Table 3 were produced by the above described processes.

TABLE 4

| Test No. | LT process Holding time t (second) | Martensite volume ratio (%) | Total number density ND (/mm$^2$) | YS (MPa) | SSC resistance |
|---|---|---|---|---|---|
| 24 | 141 | 98 | 0.38 | 857 | E |
| 25 | 134 | 100 | 0.34 | 778 | E |
| 26 | 173 | 97 | 0.28 | 775 | E |
| 27 | 147 | 99 | 0.33 | 814 | E |
| 28 | 179 | 98 | 0.28 | 836 | E |
| 29 | 134 | 99 | 0.33 | 816 | E |
| 30 | 173 | 99 | 0.30 | 833 | E |
| 31 | 87 | 100 | 0.44 | 828 | E |
| 32 | 95 | 99 | 0.41 | 831 | E |
| 33 | 163 | 100 | 0.28 | 861 | E |
| 34 | 156 | 100 | 0.33 | 775 | E |
| 35 | 158 | 98 | 0.36 | 831 | E |
| 36 | 149 | 99 | 0.39 | 806 | E |
| 37 | 172 | 99 | 0.23 | 810 | E |
| 38 | 112 | 100 | 0.39 | 811 | E |
| 39 | 138 | 97 | 0.36 | 860 | E |
| 40 | 157 | 97 | 0.25 | 820 | E |
| 41 | 141 | 97 | 1.52 | 781 | B |

TABLE 4-continued

| Test No. | LT process Holding time t (second) | Martensite volume ratio (%) | Total number density ND (/mm$^2$) | YS (MPa) | SSC resistance |
|---|---|---|---|---|---|
| 42 | 165 | 99 | 1.22 | 771 | B |
| 43 | 130 | 99 | 0.56 | 852 | B |
| 44 | 147 | 98 | 0.75 | 803 | B |
| 45 | 34 | 99 | 0.58 | 781 | B |
| 46 | 56 | 97 | 0.56 | 774 | B |

By using the molten steels of Test Nos. 24 to 46, a billet having an outer diameter of 310 mm was produced. The produced billet was heated to 1250° C. and thereafter subjected to hot rolling by the Mannesmann process to produce a hollow shell (seamless steel pipe) having an outer diameter of 244.48 mm and a wall thickness of 13.84 mm.

The hollow shells of Test Nos. 24 to 46 were subjected to quenching and tempering. As in Example 1, for any of the hollow shells of Test Nos. 24 to 46, the quenching temperature was 920° C. and the holding time at the quenching temperature was 10 minutes. The hollow shells of Test Nos. 24 to 46 after quenching were subjected to tempering. The tempering temperature was adjusted in a range of 580 to 620° C. for each test number such that the yield strength of the steel material (seamless steel pipe) after tempering was 758 to less than 862 MPa (110 ksi grade). The holding time at the tempering temperature was 30 minutes for any test number.

By the production processes described above, the steel materials (seamless steel pipes) of Test Nos. 24 to 46 were produced.

[Evaluation Test]

As in Example 1 described above, the steel materials of Test Nos. 24 to 46 after tempering were subjected to a microstructure observation test, a total number density ND measurement test, a tensile test, and an SSC resistance evaluation test.

[Measurement Test of Martensite Volume Ratio in Microstructure]

The volume ratio of martensite in the microstructure of the steel materials (seamless steel pipes) of Test Nos. 24 to 46 was obtained by the same method as in Example 1 described above. Obtained martensite volume ratios of Test Nos. 24 to 46 are shown in the "Martensite volume ratio (%)" column in Table 4.

[Measurement Test of Total Number Density ND]

The total number density ND of Mn sulfide having an equivalent circular diameter of 1.0 μm or more and Ca sulfide having an equivalent circular diameter of 2.0 μm or more in the steel materials (seamless steel pipes) of Test Nos. 24 to 46 was measured by the same method as in Example 1. The obtained total number densities ND of Test Nos. 24 to 46 are shown in "Total number density ND (/mm$^2$)" column of Table 4.

[Tensile Test]

For the steel materials (seamless steel pipes) of Test Nos. 24 to 46, a tensile test was conducted in conformity with ASTM E8/E8M (2013) by the same method as in Example 1. Obtained yield strengths of Test Nos. 24 to 46 are shown in "YS (MPa)" column of Table 4.

[SSC Resistance Evaluation Test]

For the steel materials (seamless steel pipes) of Test Nos. 24 to 46, an SSC resistance evaluation test was conducted by the same method as in Example 1. When no crack was observed even when the surface of the round bar test specimen was observed with a loupe of 10 times and an optical microscope of 100 times, it was judged that excellent SSC resistance was achieved (denoted as "E (Excellent)" in the "SSC resistance" column in Table 4). When any crack was confirmed, it was judged that excellent SSC resistance was not achieved (denoted as "B (Bad)" in the "SSC resistance" column in Table 4).

[Evaluation Results]

Referring to Tables 3 and 4, the chemical compositions of the steel materials of Test Nos. 24 to 40 were appropriate. Further, the martensite volume ratio in the microstructure was 80% or more, and the yield strength was 758 to less than 862 MPa (110 ksi grade). Further, the total number density ND of Mn sulfide having an equivalent circular diameter of 1.0 μm or more and Ca sulfide having an equivalent circular diameter of 2.0 μm or more was 0.50/mm$^2$ or less. As a result of that, excellent SSC resistance was achieved in the steel materials of Test Nos. 24 to 40.

On the other hand, in Test Nos. 41 and 42, the S content was too high in the chemical composition of steel material. As a result of that, the total number density ND of Mn sulfide having an equivalent circular diameter of 1.0 μm or more and Ca sulfide having an equivalent circular diameter of 2.0 μm or more was more than 0.50/mm$^2$. As a result, excellent SSC resistance was not achieved in the steel materials of Test Nos. 41 and 42.

In Test No. 43, the Ca content was too low in the chemical composition of the steel material. As a result of that, the total number density ND of Mn sulfide having an equivalent circular diameter of 1.0 μm or more and Ca sulfide having an equivalent circular diameter of 2.0 μm or more was more than 0.50/mm$^2$. As a result, excellent SSC resistance was not achieved in the steel material of Test No. 43.

In Test No. 44, the Ca content was too high in the chemical composition of the steel material. For that reason, the total number density ND of Mn sulfide having an equivalent circular diameter of 1.0 μm or more and Ca sulfide having an equivalent circular diameter of 2.0 μm or more was more than 0.50/mm$^2$. As a result, excellent SSC resistance was not achieved in the steel material of Test No. 44.

In Test Nos. 45 and 46, the holding time t after elapse of uniform mixing time was too short in the production process of the steel material. As a result of that, the total number density ND of Mn sulfide having an equivalent circular diameter of 1.0 μm or more and Ca sulfide having an equivalent circular diameter of 2.0 μm or more was more than 0.50/mm$^2$. As a result, excellent SSC resistance was not achieved in the steel materials of Test Nos. 45 and 46.

So far, embodiments of the present disclosure have been described. However, those embodiments are merely exemplification for practicing the present disclosure. Therefore, the present disclosure will not be limited to the embodiments, and can be practiced by appropriately modifying the embodiments within a range not departing from the spirit thereof.

The invention claimed is:

1. A steel material, comprising a chemical composition consisting of: in mass %, C: 0.035% or less;
Si: 1.00% or less;
Mn: 0.01 to 1.00%;
P: 0.030% or less;
S: 0.0050% or less;
sol. Al: 0.005 to 0.100%;
N: 0.001 to 0.020%;
Ni: 5.00 to 7.50%;
Cr: 10.00 to 14.00%;
Cu: 0.01 to 1.40%;
Mo: 1.50 to 3.50%;
V: 0.01 to 1.00%;
Ti: 0.02 to 0.30%;
Co: 0.01 to 0.50%;
Ca: 0.0003 to 0.0030%;
O: 0.0050% or less;
W: 0 to 1.50%;
Nb: 0 to 0.50%;
B: 0 to 0.0050%;
Mg: 0 to 0.0050%; and
rare earth metals (REM): 0 to 0.020%, with the balance being Fe and impurities, wherein among inclusions in the steel material, a total number density of Mn sulfide having a Mn content of 10% or more and a S content of 10% or more, and having an equivalent circular diameter of 1.0 μm or more, and Ca sulfide having a Ca content of 20% or more, a S content of 10% or more, and a Mn content of less than 10%, and having an equivalent circular diameter of 2.0 μm or more is $0.50/mm^2$ or less.

2. The steel material according to claim 1, wherein the chemical composition contains
W: 0.01 to 1.50%.

3. The steel material according to claim 1, wherein the chemical composition contains
Nb: 0.01 to 0.50%.

4. The steel material according to claim 2, wherein the chemical composition contains
Nb: 0.01 to 0.50%.

5. The steel material according to claim 1, wherein the chemical composition contains one or more types of element selected from the group consisting of:
B: 0.0001 to 0.0050%,
Mg: 0.0001 to 0.0050%, and
rare earth metals (REM): 0.001 to 0.020%.

6. The steel material according to claim 2, wherein the chemical composition contains one or more types of element selected from the group consisting of:
B: 0.0001 to 0.0050%,
Mg: 0.0001 to 0.0050%, and
rare earth metals (REM): 0.001 to 0.020%.

7. The steel material according to claim 3, wherein the chemical composition contains one or more types of element selected from the group consisting of:
B: 0.0001 to 0.0050%,
Mg: 0.0001 to 0.0050%, and
rare earth metals (REM): 0.001 to 0.020%.

8. The steel material according to claim 4, wherein the chemical composition contains one or more types of element selected from the group consisting of:
B: 0.0001 to 0.0050%,
Mg: 0.0001 to 0.0050%, and
rare earth metals (REM): 0.001 to 0.020%.

9. The steel material according to claim 1, wherein the steel material is a seamless steel pipe for oil country tubular goods.

10. The steel material according to claim 2, wherein the steel material is a seamless steel pipe for oil country tubular goods.

11. The steel material according to claim 3, wherein the steel material is a seamless steel pipe for oil country tubular goods.

12. The steel material according to claim 4, wherein the steel material is a seamless steel pipe for oil country tubular goods.

13. The steel material according to claim 5, wherein the steel material is a seamless steel pipe for oil country tubular goods.

14. The steel material according to claim 6, wherein the steel material is a seamless steel pipe for oil country tubular goods.

15. The steel material according to claim 7, wherein the steel material is a seamless steel pipe for oil country tubular goods.

16. The steel material according to claim 8, wherein the steel material is a seamless steel pipe for oil country tubular goods.

* * * * *